US006615518B2

(12) United States Patent
Pia et al.

(10) Patent No.: US 6,615,518 B2
(45) Date of Patent: Sep. 9, 2003

(54) INDICIA DISPLAYING STATIONERY PRODUCTS

(75) Inventors: Gary Pia, Stratford, CT (US); Mark C. Matthews, Sommerville, MA (US); David H. Oliver, Brookline, MA (US); Ron Vish, West Roxbury, MA (US)

(73) Assignee: Acme United Corporation, Fairfield, CT (US)

( * ) Notice: Subject to any disclaimer, the term of this patent is extended or adjusted under 35 U.S.C. 154(b) by 0 days.

(21) Appl. No.: 09/865,955

(22) Filed: May 25, 2001

(65) Prior Publication Data

US 2002/0029502 A1 Mar. 14, 2002

Related U.S. Application Data

(63) Continuation-in-part of application No. 09/491,508, filed on Jan. 26, 2000, now Pat. No. 6,263,599, which is a continuation of application No. 09/164,688, filed on Oct. 1, 1998, now Pat. No. 6,041,530.

(60) Provisional application No. 60/065,640, filed on Nov. 18, 1997.

(51) Int. Cl.[7] ..... G09F 3/20; G09F 3/18

(52) U.S. Cl. ..... 40/358; 40/642.02; 40/913

(58) Field of Search ..... 40/314, 317, 334, 40/358, 626, 651, 661, 661.07, 913, 915, 330, 634, 642.02; D8/57; D20/19; 30/232, 254, 341

(56) References Cited

U.S. PATENT DOCUMENTS

| | | | | | |
|---|---|---|---|---|---|
| 876,317 | A | * | 1/1908 | Booth | 40/314 |
| 1,350,275 | A | * | 8/1920 | Gafinowitz | 40/317 |
| 1,815,154 | A | * | 7/1931 | Larson | 40/328 |
| 4,216,862 | A | * | 8/1980 | Daenen | 206/541 |
| 4,258,472 | A | * | 3/1981 | Wallace et al. | 30/262 |
| 4,291,475 | A | * | 9/1981 | Schoemer | 40/338 |
| 5,421,090 | A | * | 6/1995 | Chiou | 30/254 |
| 5,517,761 | A | * | 5/1996 | Wang | 30/254 |
| 5,769,859 | A | * | 6/1998 | Dorsey | 606/119 |
| 6,041,530 | A | * | 3/2000 | Matthews et al. | 40/358 |
| 6,263,599 | B1 | * | 7/2001 | Matthews et al. | 40/358 |

FOREIGN PATENT DOCUMENTS

| | | | | |
|---|---|---|---|---|
| GB | 2266759 | * | 11/1993 | 40/661 |

* cited by examiner

*Primary Examiner*—Brian K. Green
(74) *Attorney, Agent, or Firm*—Melvin I. Stoltz

(57) ABSTRACT

By providing any desired stationery product with a movable or removable panel member which cooperates with the surface or body of the stationery product, a unique indicia retaining and displaying system is realized. Preferably, the panel member is movably or removably mounted to the stationery product for ease of insertion of an indicia bearing member and secure retention thereof when the panel member is returned to its original position. In addition, the panel member preferably comprises a transparent zone, in order to enable the indicia bearing member to be easily viewed.

14 Claims, 19 Drawing Sheets

INDICIA DISPLAYING STATIONERY PRODUCTS

RELATED APPLICATIONS

This application is a Continuation-in-Part of U.S. Ser. No. 09/491,508, filed Jan. 26, 2000 entitled Indicia Displaying Stationery Products, now U.S. Pat. No. 6,263,599, which is a Continuation Application of U.S. Ser. No. 09/164,688, filed Oct. 1, 1998 entitled Indicia Displaying Stationery Products, now issued as U.S. Pat. No. 6,041,530 on Mar. 28, 2000, which is related to Provisional Patent Application Serial No. 60/065,640, filed Nov. 18, 1997 entitled Scissors Construction with Personal Identification Holder.

TECHNICAL FIELD

This invention relates to stationery products and, more particularly, to a unique construction for stationery products which provide an easily employed, pivoted display or arm member incorporating integrally formed identification display means.

BACKGROUND ART

Substantial effort has been expended for many years in improving the construction and operation of stationery products, such as shears, scissors, graduated and ungraduated rulers, staplers, tape dispensers, and the like. As is evident from this activity, numerous attempts have been made to improve the ease of manufacture, assembly, and operation of these products, as well as the ability of having individuals easily identifying the owner of these products. However, in spite of this substantial effort, difficulties continue to exist.

Ever increasing demands have been placed on manufacturers of stationery products to increase the ease of operation of the tools by the consumer, as well as provide a tool which is rapidly manufactured and assembled. In particular, in such products specifically designed for use by children, efficiency in production and assembly must be realized in order to attain a product which can be sold at competitive prices.

Although various attempts have been made to achieve a product construction and assembly which enables the desired product to be manufactured and produced at a minimum expense, such efforts have failed to provide a final product which is capable of withstanding all of the demands placed on the product by the users. Consequently, the need for improvements in the manufacture and assembly of such products has continued, with the industry requiring improvements in design, structure, assembly, and operational ease.

In addition to attempting to resolving these existing problems, prior art stationery products have also been unable to allow individuals to quickly and easily incorporate a tag or label as an integral part of the product in order to enable the owner of the product to be identified in a convenience and aesthetically pleasing manner. Presently, no system exists which enables ownership identification to be incorporated directly within the stationery product itself, as an integral component thereof, eliminating unsightly printed tags for labels affixed by adhesive means to the outer surface of the stationery products. Although substantial interest has existed for many years in having achieving an integrally formed system to accommodate product identification, no prior art system has been developed to satisfy this need.

Therefore, it is a principal object of the present invention to provide stationery products which are constructed in a manner to enable the product to be quickly and easily assembled while also enabling the products to be easily and conveniently employed by the consumer.

Another object of the present invention is to provide stationery products having the characteristic features described above which incorporate integrally formed, pivotal cover or arm member which is capable of securely retaining a label, tag, or other identification means for designating the owner of the product.

Other and more specific objects will in part be obvious and will in part appear hereinafter.

SUMMARY OF THE INVENTION

By employing the present invention, the difficulties and drawbacks found with prior art systems have been overcome and stationery product constructions are attained which provide ease of manufacture and assembly, as well as incorporating an integrally formed, easily manufactured identification label retaining and displaying zone. Employing the teaching of this invention, rugged, wear-resistant, long-lasting product constructions are realized which are capable of being achieved with substantial ease and simplicity.

In the present invention, a minimum of components are employed to produce the product constructions of this invention. In particular, by employing the present invention, any desired stationery product is able to be constructed with means for enabling an identification label or tag means to be retainingly inserted into a holding zone. In this way, individuals, particularly children and office workers, are able to identify their stationery products and distinguish their own products from the products of others. As a result, all individuals are able to personalize their products, if so desired, to assure their availability when needed. In addition, the personalization of these stationery products enables individuals to be able to freely share their products with others, while simultaneously enjoying a sense of pride in knowing and being recognized for such sharing, as well as knowing the products will be easily recognized and returned.

In one preferred embodiment, any desired stationery product is constructed with a separate plate member which incorporates and integrally formed, arcuately shaped boss extending from one surface of the plate. In addition, a cooperating surface of the stationery product incorporates a cooperating boss receiving zone. Alternatively, the placement of these components can be reversed with the upstanding arcuately shaped boss member being formed on the stationery product and the boss receiving zone being formed on the plate member.

By mounting these component in cooperating interengagement with each other, the plate member is able to arcuately pivot relative to the remainder of the stationery product. In this way, an easily constructed, arcuately pivotable identification label retaining and displaying zone is achieved which is integrally interconnected with the stationery product, forming a cooperating, integrally constructed portion thereof.

In the preferred construction, the plate member is formed from transparent material and incorporates a receiving zone within which any desired identification tag or label is easily placed and retained for easy visibility. As a result, the desired stationery product is constructed with a specially designated identification label retaining and displaying zone integrally formed therewith for use by the product owner.

By employing the present invention, a stationery product is constructed with a specific identification zone integrally formed therewith providing a unique distinctive construction enabling the user to quickly and easily position an identifying tag or label in direct association with the product as an integral part thereof, thereby designating the proprietor of the particular stationery product or providing any other desired information. Although the preferred construction employs affixing a cooperating plate or cover member in pivotable mounted interengagement with the stationery product to establish an easily employable, integrally formed identification zone for the product, numerous alternate constructions can be employed without departing from the scope of the present invention.

If desired, an identification zone forming plate or cover member can be securely and integrally affixed to the stationery product by employing other securement systems or methods, such as sliders, locks, snap connections, and the like. In this way, any desired stationery product can be constructed with a specific identification zone integrally formed as a part of the stationery product, providing an easily used, a readily accessible, integral component for the stationery product.

As would be apparent to one of ordinary skill in this art, stationery products such as rulers, staplers, tape dispensers, triangles, pencil boxes, and the like, may be constructed with the identification zone formed by a plate or cover member integrally interconnected and movable relative to the product structure. As detailed above, a pivotal plate or cover is preferred. However alternate constructions employing sliders, snap connections, or other lock systems can be employed with equal efficacy.

In addition to these products, other stationery products which incorporate cooperating members pivotally mounted to each other, such as the shears, scissors, garden cutters, and the like may employ the present invention with a unique construction incorporating the plate or cover member of the identification label retaining and displaying zone interconnected with the pivot means of the product itself. In this way, a unique product construction is realized, providing ease of assembly and construction, while also incorporating a readily accessible, integrally formed product identification zone.

In this regard, in providing scissors, shears, or cutter constructions which are easily manufactured and assembled, while also achieving a rugged, long-lasting, wear-resistant product, each of the two, cooperating, pivotable arm members forming the product may be formed from a single component or, in the preferred embodiment, formed from a blade portion and a handle portion, which are integrally, securely mounted in engagement with each other to form a pivotable arm member. In addition, each of the cooperating, pivotable arm members incorporates a pivot forming aperture formed therein which is constructed for receiving and cooperatively interengaging with a pivot forming boss or pin.

In the preferred construction, a pivot forming boss is employed for being inserted into the apertures formed in the pivotable arm members of the scissors, shears, or cutter product, with the boss preferably being integrally formed with an overlying cover plate. In this construction, the cover plate is cooperatively associated with part of one handle portion.

In this way, with the cover plate preferably formed from transparent material, the cover plate functions as a receiving zone for the identifying label to enable the personalization of the scissors, shears, or cutter construction. Although alternate constructions can be employed for attaining an identification retaining member integrally formed with one handle member, including a cover plate which is not pivotable, the preferred embodiment employs a separate, arcuately pivotable cover plate integrally interconnected with the pivot forming boss.

In this regard, in order to attain an easily assembled, inexpensively produced product construction, the pivotable arm members of the product are preferably formed using plastic molded handle portions and preformed blade portions integrally affixed to the handle portions to form the desired arm member. By constructing these components for easy, rapid, ready interengagement with each other, manufacturing simplicity is attained and minimal assembly time is required to attain the unique, desirable, rugged scissors construction of this invention.

The invention accordingly comprises an article of manufacture possessing the features, properties, and relation of elements which will be exemplified in the articles hereinafter described.

THE DRAWINGS

For a fuller understanding of the nature and objects of the invention, reference should be had to the following detailed description taken in connection with the accompanying drawings, in which.

DETAILED DESCRIPTION

By referring to FIGS. 1–31, along with the following detailed disclosure, the construction and operation of the various embodiments of the stationery products of the present invention can best be understood. Although various alternate constructions are depicted and disclosed herein, further alternate constructions can be employed without departing from the scope of this invention. Consequently, it is to be understood that the constructions set forth herein are provided as exemplary constructions and are not intended to limit the scope of the present invention.

In FIGS. 1–15 and 26–31, several alternate embodiments for stationery products 20 are provided wherein stationery product 20 is in the form of a product having a pair of cooperating, pivotally interconnected arm members, such as are found with scissors, shears, gardening tools or cutters, and the like. For exemplary purposes only, stationery product 20 is depicted in FIGS. 1–15 and 26–29 as a pair of scissors.

Figure 24:
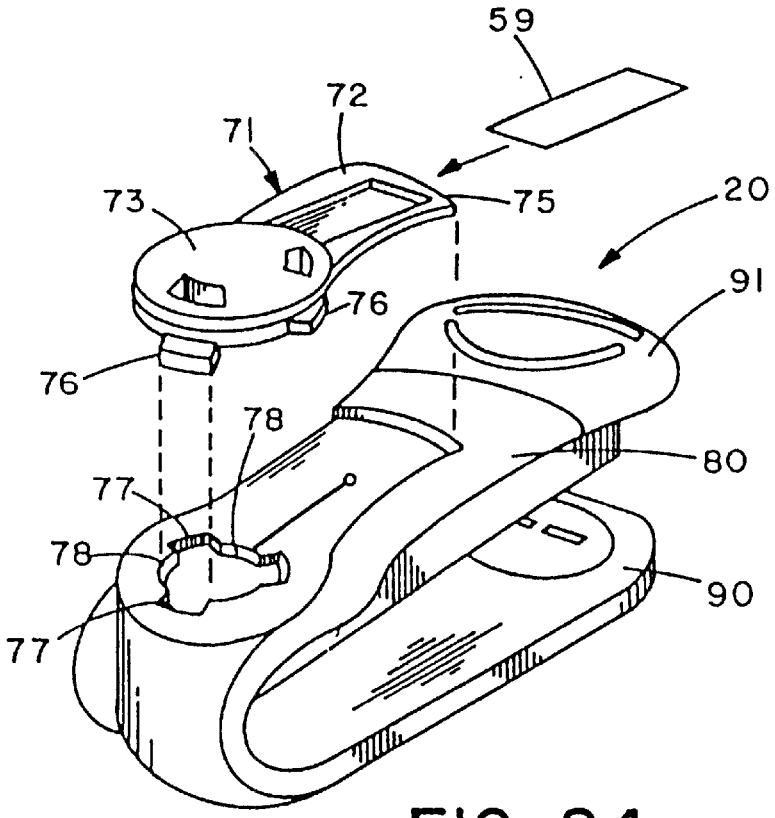
FIG. 24 is a partially exploded top perspective view of a still further embodiment of a stationery product of the present invention in the form of a stapler.
Figure 25:
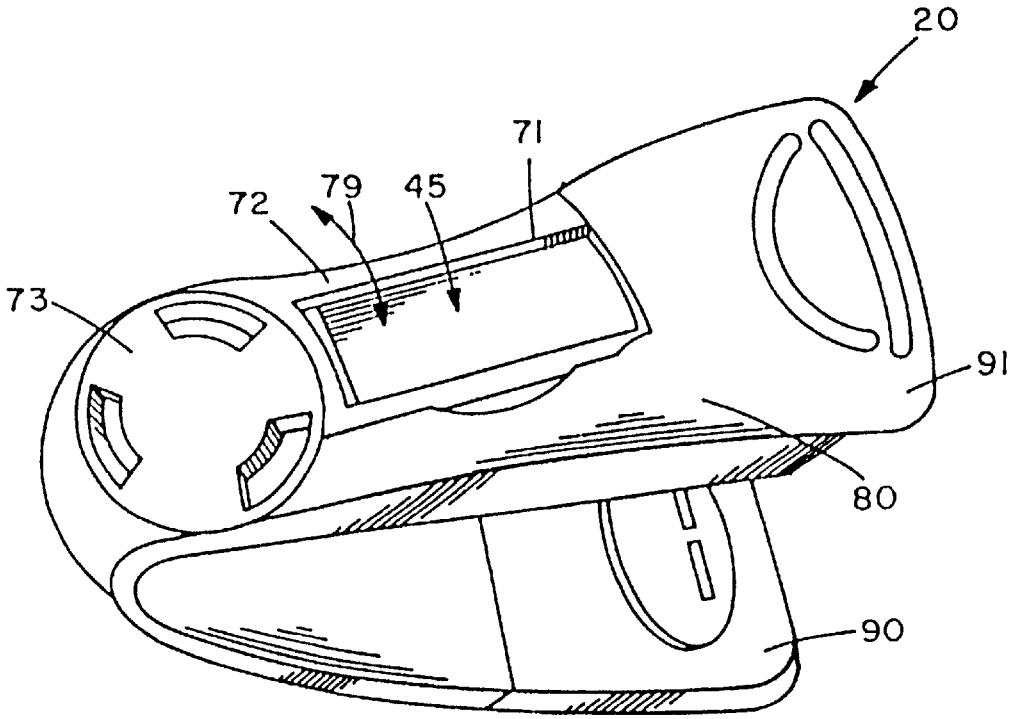
FIG. 25 is a top perspective view of the fully assembled stapler construction of FIG. 24.

In FIGS. 16–23, stationery product 20 is depicted as a drafting or drawing ruler incorporating an integrally formed, pivotable plate or cover member forming the desired identification label holding and displaying zone. Finally, FIGS. 24–25 depict stationery product 20 as a stapler which incorporates a pivotal plate or cover member to form the integrally constructed, identification label holding and retaining zone of the present invention.

As is evident from the following detailed disclosure, wherein the preferred constructions for these alternate embodiments of stationery products are provided, the present invention can be implemented in a wide variety of different products employing a wide variety of alternate constructions and configurations. However, it is to be understood that the following detailed disclosure represents a complete teaching of the best mode for carrying out the present invention, while encompassing all of the alternate constructions coming within the scope and purview of the present invention.

In FIGS. 1–9, one preferred embodiment of the pivotable member construction of the present invention is shown. In this embodiment, stationery product/scissors 20 comprises a pair of pivotable arm members 21 and 22. Arm member 21 comprises a handle portion 23, and a blade portion 24, while arm member 22 comprises a handle portion 25 and a blade portion 26.

As best seen in FIGS. 6–9, handle portions 23 and 25 each comprise a pivot pin receiving passageway 30, while blade members 24 and 26 each comprise a pin receiving passageway 31. In addition, as further discussed below, blade portions 24 and 26 also incorporate mounting holes 32 preferably formed at the distal end of blade portions 24 and 26 for cooperating with staking posts 34 formed on each handle portion and positioned for telescopic insertion in mounting holes 32 of each blade portion 23 and 25 for securely retaining blade portion 24 to handle portion 23 and blade portion 26 to handle portion 25.

In order to complete the construction of this preferred embodiment of scissors 20, pivot forming boss 36 is employed. Boss 36 is constructed for telescopic insertion and engagement within passageways 30 of handle portions 23 and 25 and passageways of 31 of blade portions 24 and 26. With pivot forming boss 36 telescopically engaged within these cooperating passageways, the desired pivot axis for arm members 21 and 22 is established. In order to securely maintain pivot forming boss 36 in position in cooperating, holding, pivoted interconnected engagement with arm members 21 and 22, boss locking means 37 is employed, preferably in the form of a threaded screw.

Figure 1:
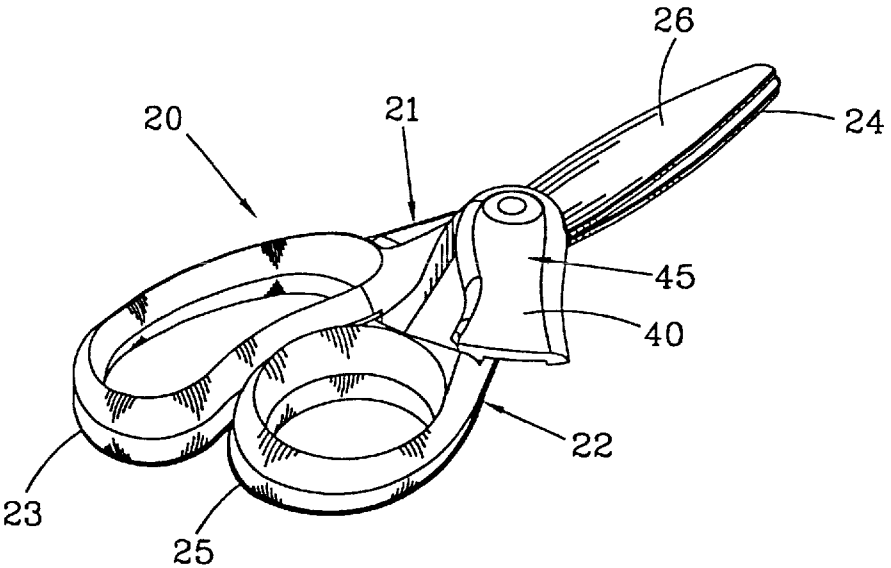
FIG. 1 is a perspective view of the stationery product of the present invention in the form of a fully assembled scissors construction with the identification holding plate member thereof depicted arcuately pivoted away from the pivotable arm member for ease of insertion of a desired tag or label.
Figure 2:
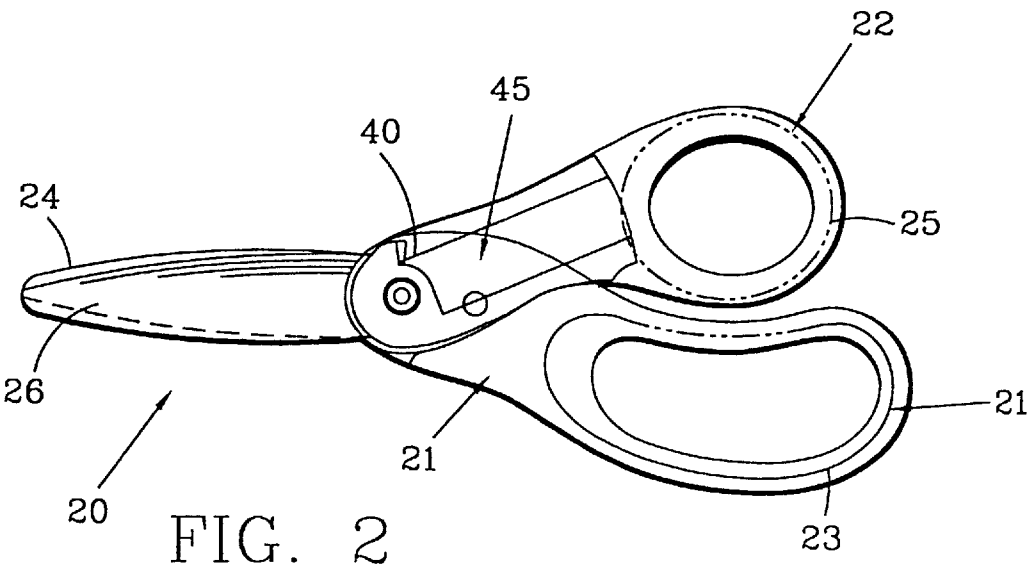
FIG. 2 is a top plan view of the scissors construction of the present invention depicted with the cover plate arcuately pivoted into its engaged, overlying position with the pivotable arm member.
Figure 3:
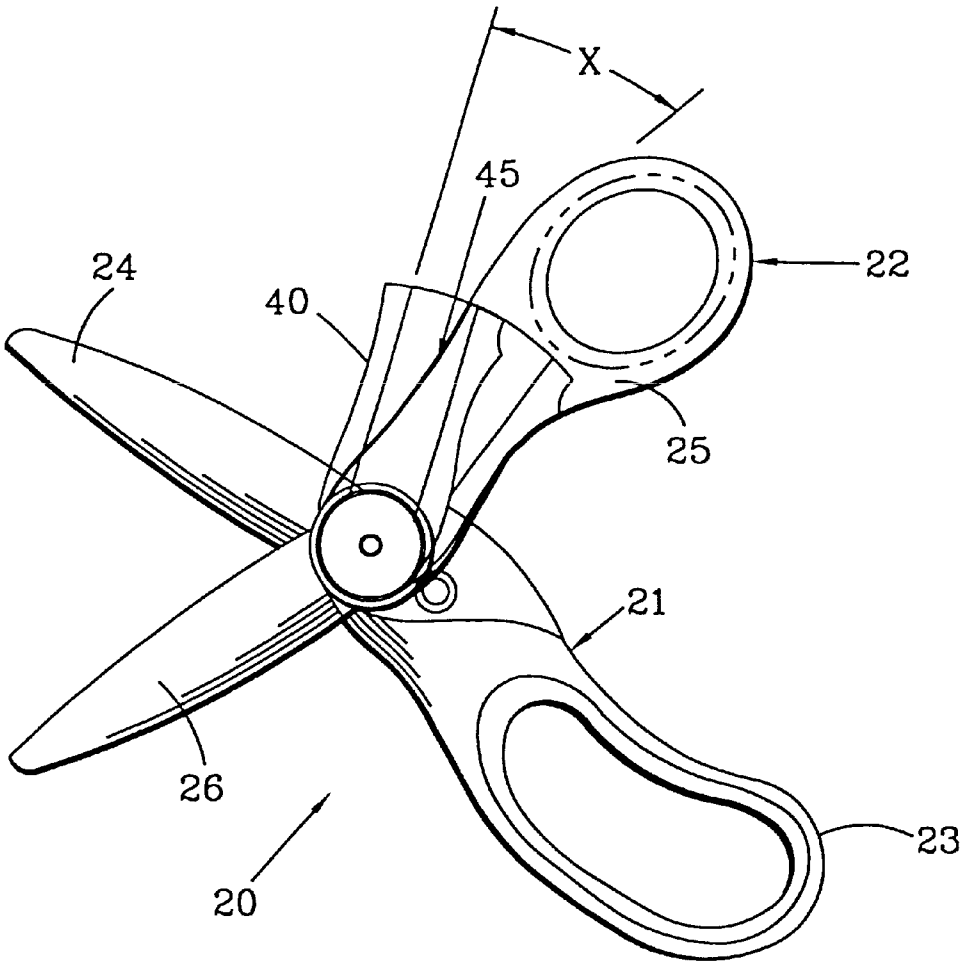
FIG. 3 is a top plan view of the scissors construction of the present invention of FIG. 1 with the pivotable arm members thereof arcuately pivoted into a disengaged configuration.

As detailed herein, in this embodiment of scissors 20, cover plate 40 is employed to form label identification holding and displaying zone 45. In order to achieve this result, cover plate 40 is constructed from transparent material and is securely mounted to one end of pivot forming boss 36. In this way, as depicted in FIGS. 1 and 3, cover plate 40 is capable of arcuate pivoting movement about the pivot axis established by boss 36, enabling cover plate 40 to move into and out of overlying secure engagement with handle portion 25. Furthermore, for ease of access, cover plate 40 is arcuately movable through an arc depicted as "X".

By constructing cover plate 40 with an elongated recess zone 46, formed on one surface thereof, and positioned in juxtaposed, spaced, cooperating, overlying relationship with the surface of handle portion 25, identification label holding and displaying zone 45 is established. This is clearly shown in FIGS. 5 and 7. Furthermore, in the preferred construction, handle portion 25 incorporates an area of reduced thickness which is constructed for cooperative receipt of cover plate 40 to provide nested engagement thereof with handle portion 25. In this way, the resulting construction of handle 25 provides an overall dimension substantially equivalent to the dimensions of handle portion 23.

By employing this preferred embodiment of these constructions of the present invention, cover plate 40 is pivoted out of overlying engagement with handle portion 25, enabling the user to easily insert any identification label onto either the inside surface 46 of plate 40 or handle portion 25. Then, by arcuately pivoting cover plate 40 back to its original overlying, nested position, the desired indicia on the tag/label inserted therewith is securely retained and displayed.

Figure 5:
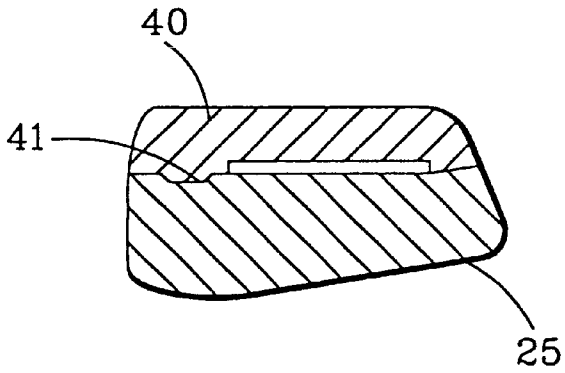
FIG. 5 is a cross-sectional end view of the scissors construction taken along line 5—5 of FIG. 2.
Figure 4:
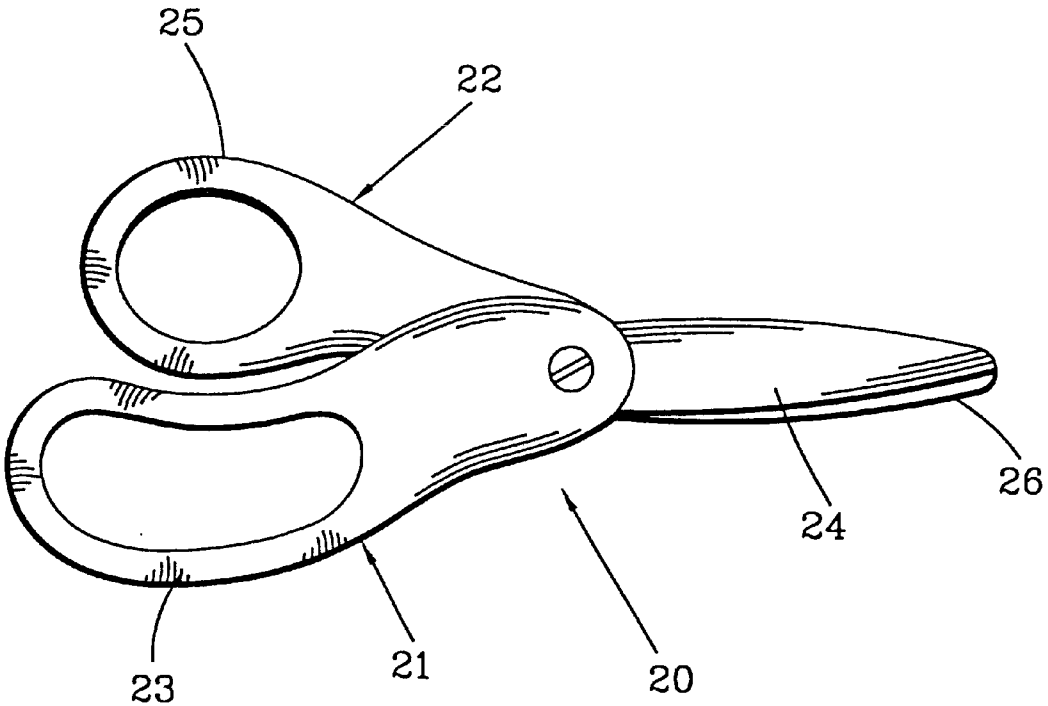
FIG. 4 is a bottom view of the scissors construction of the present invention.
Figure 6:
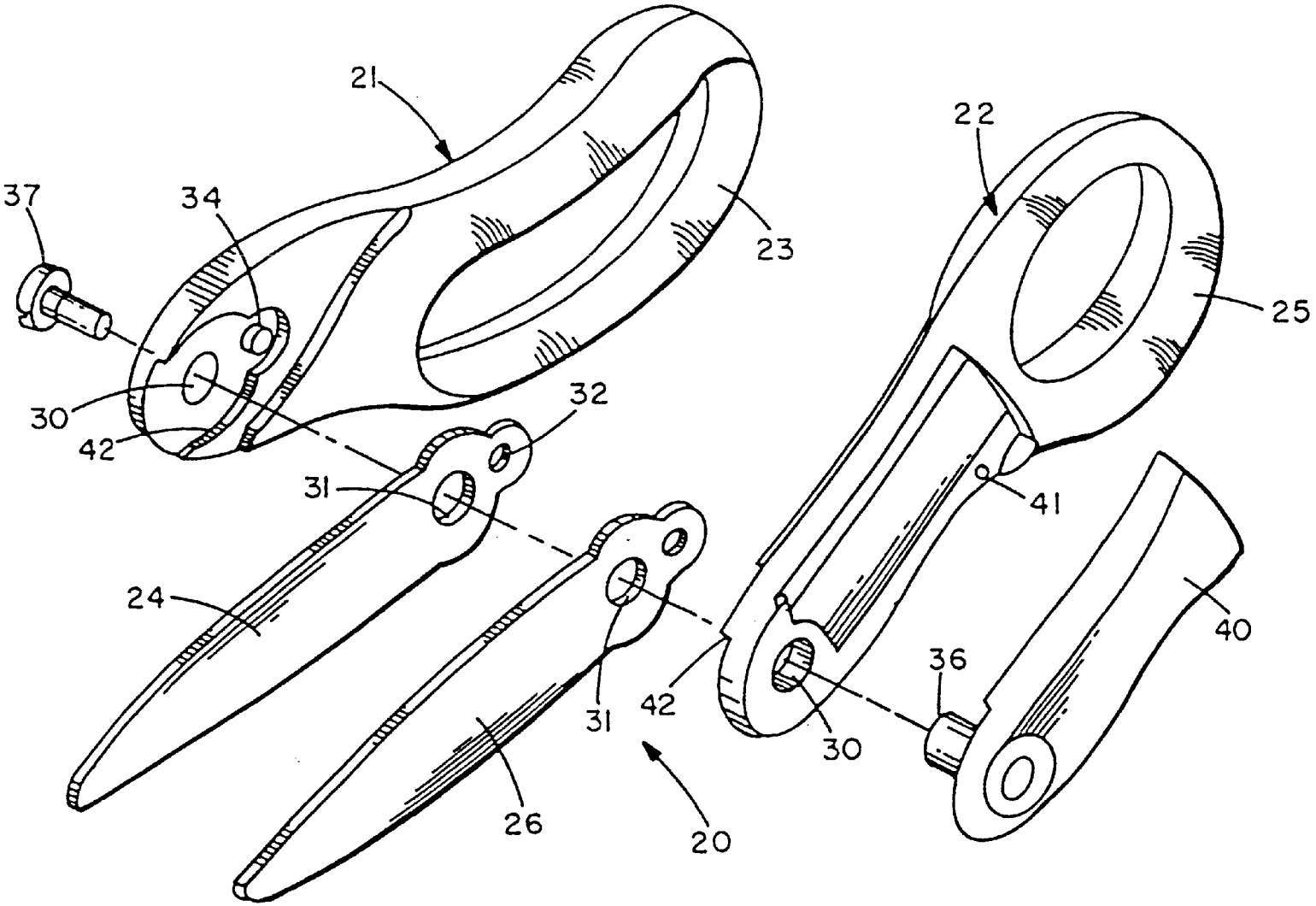
FIG. 6 is an exploded perspective view of the scissors construction of the present invention.
Figure 7:
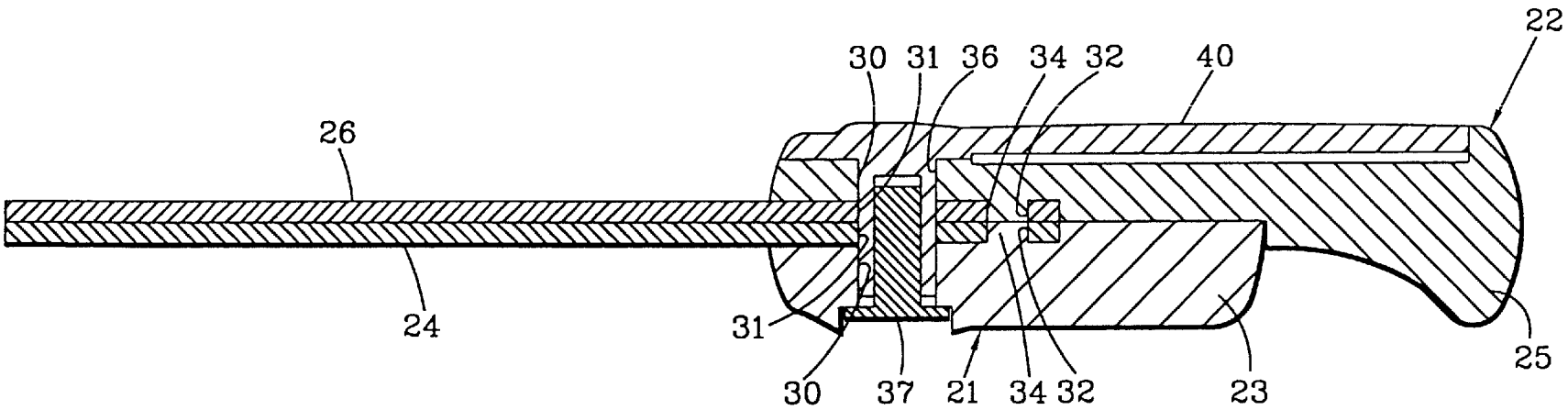
FIG. 7 is a cross-sectional side view of the scissors construction of the present invention taken along line 7—7 of FIG. 2.
Figure 8:
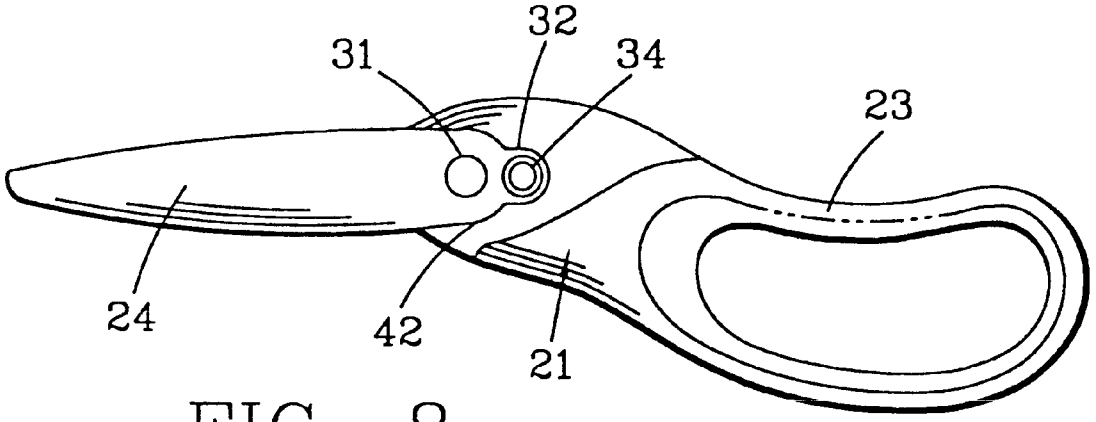
FIG. 8 is a top plan view of one pivotable arm member forming the scissors construction of the present invention.
Figure 9:
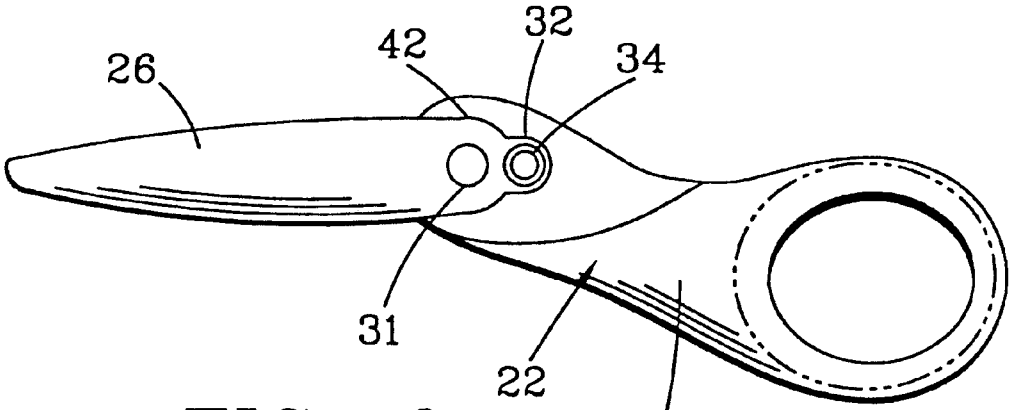
FIG. 9 is a top plan view of a second pivotable arm member of the scissors construction of the present invention.

In order to securely maintain cover plate 40 in engagement with handle portion 25 and assure retention of the identification label therebetween, cover plate 40 and handle portion 25 incorporate locking means 41 as best seen in FIGS. 5 and 6. Although various alternate constructions can be employed for providing locking means 41, a boss and associated recess are depicted for exemplary purposes.

As shown in FIGS. 6–9 and briefly discussed above, blade portions 24 and 26 are securely affixed to handle portions 23 and 25 by securely staking each blade portion to each handle portion. In the preferred embodiment, each blade portion 24 and 26 incorporates a mounting hole 32 formed therein which is constructed for cooperative interengagement with upstanding staking post 34 formed on each handle portion 23 and 25. In addition, each handle portion 23 and 25 incorporates a blade receiving cavity 42 for receiving and securely retaining blade 24 or 26 in the precisely desired location, with the boss receiving passageway 31 of each blade portion aligned with passageway 30 of each handle portion.

In order to securely affix blade portions 24 and 26 to handle portions 23 and 25 in an easily achieved, rapidly assembled manner, each blade portion 24 and 26 is positioned in a blade receiving cavity 42 of one handle portion 23 and 25 with staking post 34 telescopically engaged through mounting hole 32 of blade portion 24 and 26. Thereafter, using conventional fastening means, such as ultrasonic welding or thermal heating, staking post 34 of each handle member 23 and 25 is melted to securely affix blade portions 24 and 26 to their respective handle portion 23 and 25.

Using this simple technique, secure affixation of each blade member 24 and 26 to one of the respective handle portions 23 and 25 is quickly and easily attained. Then, with blade portion 24 securely affixed to handle portion 23 and blade portion 26 securely affixed to blade portion 25, arm assemblies 21 and 22 are completely assembled, ready for secure affixation to each other to attain the desired scissors construction.

As is evident from the foregoing detailed disclosure, quick, easy, rapid construction and assembly of the preferred embodiment of scissors 20 of the present invention is easily attained. Furthermore, by employing the present invention, a rugged, long-lasting scissors construction is attained which is manufacturable in a cost efficient manner. Furthermore, a scissors construction is realized which also provides an easily employed, integrally formed identification retaining means for enabling individuals to personalize a pair of scissors, by secure retention of identifying indicia.

In FIGS. 10–15, alternate embodiments of the present invention are depicted. In each of these embodiments, an alternate construction or assembly system is detailed for achieving an easily assembled, long-lasting, rugged scissors construction which enables identifying means to be securely inserted in the scissors and retained thereby. For ease of understanding and consistency, in each of these embodiments, numeral identifications consistent with numerals employed in FIGS. 1–9 have been used to refer to a similar component or element.

Figure 10:
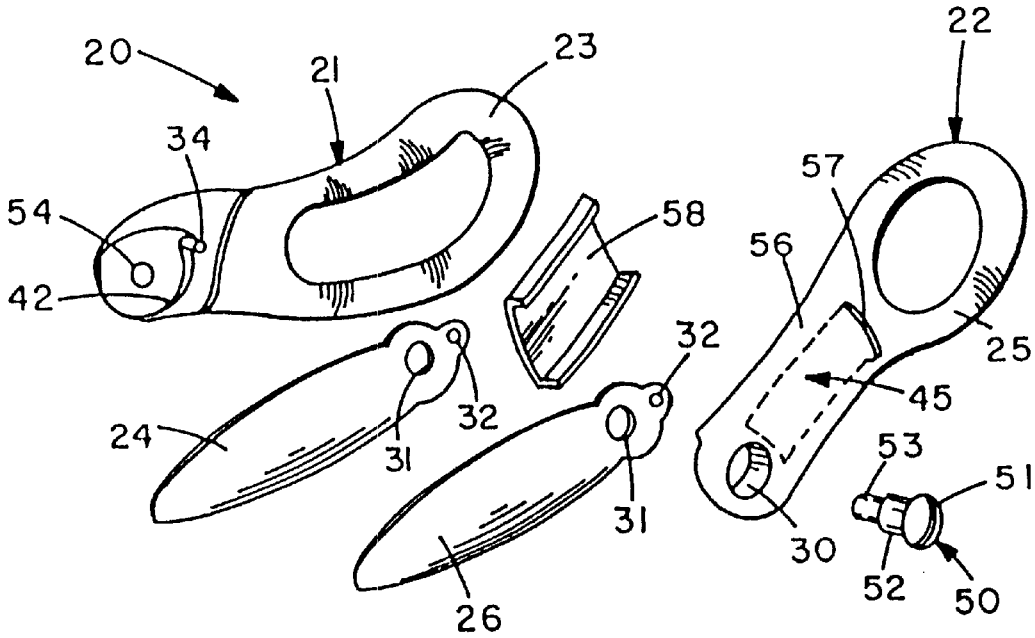
FIG. 10 is an exploded perspective view of an alternate embodiment of the scissors construction of the present invention.
Figure 11:
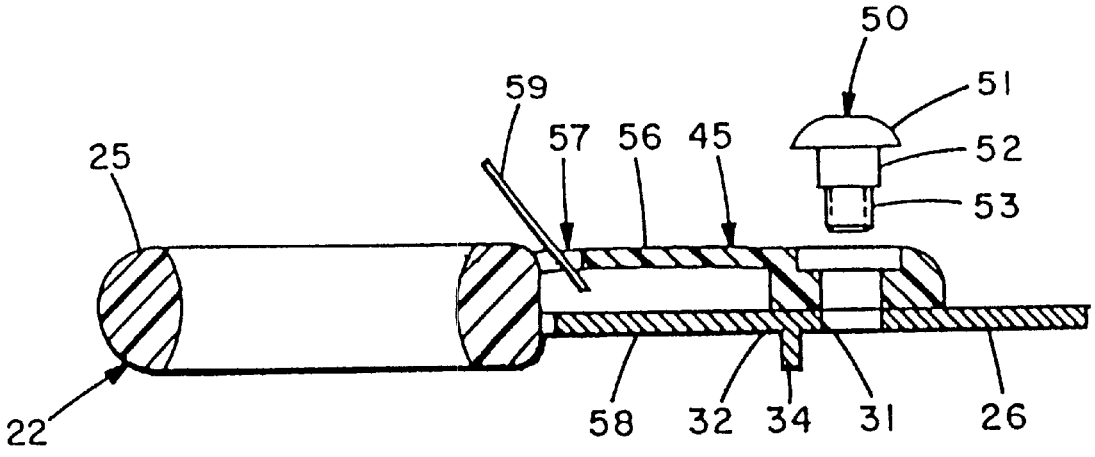
FIG. 11 is a cross-sectional top plan view of one arm member of the scissors construction of FIG. 10.

In the embodiment depicted in FIGS. 10 and 11, handle members 21 and 22 are constructed in a manner similar to the embodiments detailed above. In this embodiment, blade portions 24 and 26 are securely affixed to handle portions 23 and 25 by securely staking each blade portion to each handle portion by forming mounting holes 32 in each blade portion which are constructed for cooperative interengagement with upstanding staking post 34 formed in each handle portion 23 and 25. In addition, each handle portion 23 and 25 incorporate a blade receiving cavity 42 for receiving and securely retaining blades 24 and 26 in the precisely desired location, with pivot receiving passageways 31 formed in each blade portion and aligned with passageway 30 of handle portions 25.

In this embodiment, in order to securely affix blade portions 24 and 26 to handle portions 23 and 25 in an easily achieved, rapidly assembled manner, each blade portions 24 and 26 is positioned in blade receiving cavity 42 of associated handle portions 23 and 25 with staking posts 34 telescopically extending through mounting holes 32 of blade portions 24 and 26. Thereafter, using conventional fastening means, such as ultrasonic welding or thermal heating, staking posts 34 of each handle member 23 and 25 is melted to securely affix blade portions 24 and 26 to their respective handle portions 23 in 25.

In order to provide the desired pivotable, locked interengagement of arm assemblies 21 and 22 to each other, a locking/pivot screw 50 is employed. In the preferred construction, locking/pivot screw 50 incorporates an enlarged head 51 from which a generally cylindrically shaft extends which comprises shaft portions 52 and 53. Shaft portion 52 of locking/pivot screw 50 is directly adjacent head 51 and comprises a cylindrically shaped, smooth surface.

In addition, the length of shaft portion 52 is substantially equivalent to the axial length of passageways 31 of blade portions 24 and 26 plus the axial length of passageway 30 of handle portion 25. In this way, shaft portion 52 forms the pivot surface for handle members 21 and 22, enabling these members to arcuately pivot in the desired manner.

Finally, the shaft of locking/pivot screw 50 terminates with shaft portion 53 which preferably incorporates threads formed in the outer surface thereof. Threaded shaft portion 53 is constructed for cooperating, threaded interengagement with threaded zone 54 formed in handle member 23. By employing this construction, as is well known in the art, locking/pivot screw 50 is mounted through the receiving passageways of arm assemblies 21 and 22 and securely mounted in threaded zone 54 of handle member 23. In this way, the desired pivotable interconnected interengagement of arm members 21 and 22 is obtained for providing the desired cutting action.

In this embodiment, in order to provide the desired identification label holding and displaying zone 45, handle portion 25 incorporates a transparent zone or surface 56 and a cooperating slot 57 formed therein. Preferably, surface 56 and slot 57 are formed in handle portion 25 between passageway 30 and the finger loop formed adjacent the distal end of handle portion 25. In addition, a backing plate 58 is employed and mounted to the inside surface of handle member 25 in cooperating relationship with transparent zone 56 and slot 57.

As clearly shown in FIG. 11, backing plate 58 provides a rear surface for transparent zone 56 of handle portion 25. As a result, whenever an individual inserts any desired identifying label or tag 59 into slot 57 to be displayed through transparent zone 56, backing plate 58 cooperates with transparent zone 56 and slot 57 to provide a surface on which identifying label or tag 59 is securely retained in the precisely desired position and location. As a result, by employing this embodiment of the present invention, the desired identifying label holding and displaying zone 45 is realized in an alternate construction capable of production easily and economically.

Figure 12:
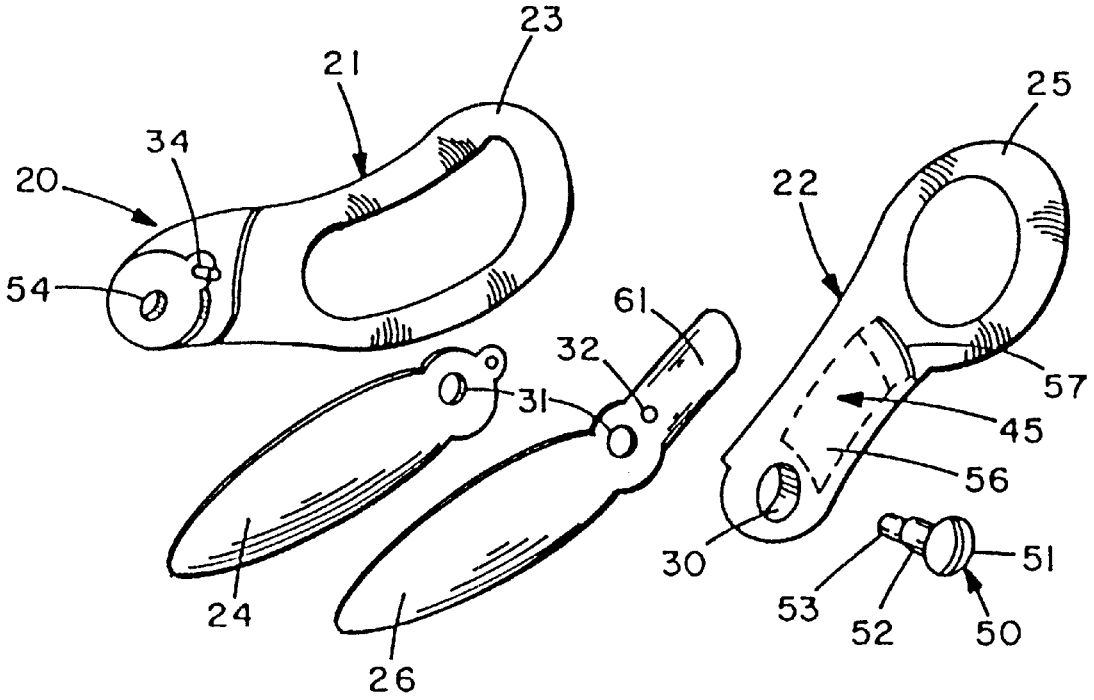
FIG. 12 is an exploded perspective view of a still further embodiment of the scissors construction of the present invention.
Figure 13:
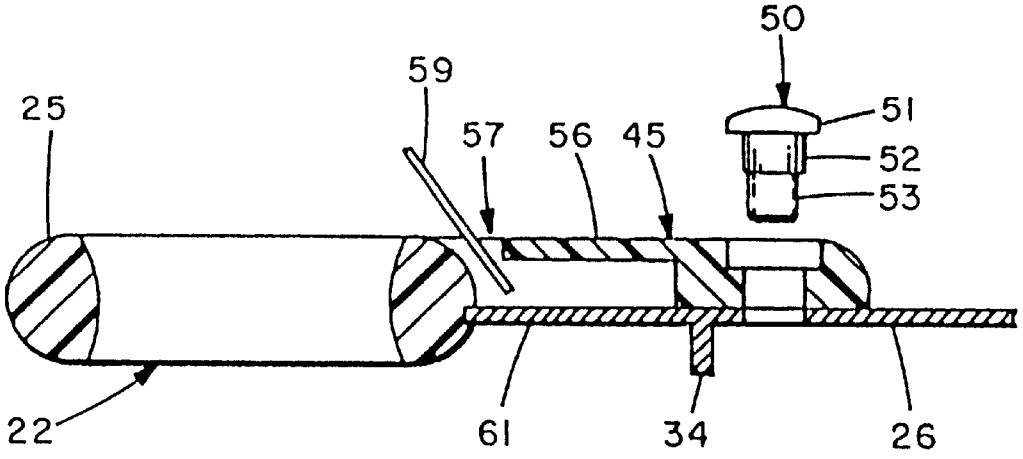
FIG. 13 is a cross-sectional side view of one arm member of the scissors construction of FIG. 12.

In FIGS. 12 and 13, a further alternate embodiment for constructing scissors 20 of the present invention is depicted. In this embodiment, arm members 21 and 22 are constructed substantially identically to the construction system detailed above in reference to the scissors of FIGS. 10 and 11. In this regard, arm members 21 and 22 are constructed with blade portions 24 and 26 securely affixed to handle portions 23 and 25 in the manner detailed above. In addition, arm members 21 and 22 are secured to each other in pivotal interengagement by employing locking/pivot screw 50.

In addition, handle portion 25 incorporates transparent zone/surface 56 which cooperates with slot 57 formed therein. However, in this embodiment, in order to provide a rear backing surface for securely retaining identification label 59, blade portion 26 incorporates a rearwardly extending plate 61 integrally formed therewith.

By employing this embodiment, when blade portion 26 is securely mounted to handle portion 25, rearwardly extending plate 61 is automatically positioned and mounted in juxtaposed, spaced, cooperating relationship with transparent zone/surface 56 of handle portion 25. As a result, a rear, supporting surface is established for receiving and retaining identification label or tag 59 when inserted through slot 57 of handle portion 25, thereby enabling identification label or tag 59 to be easily viewed and read through transparent zone 56. In this way, the desired identification label holding and displaying zone 45 of this embodiment is attained.

Figure 14:
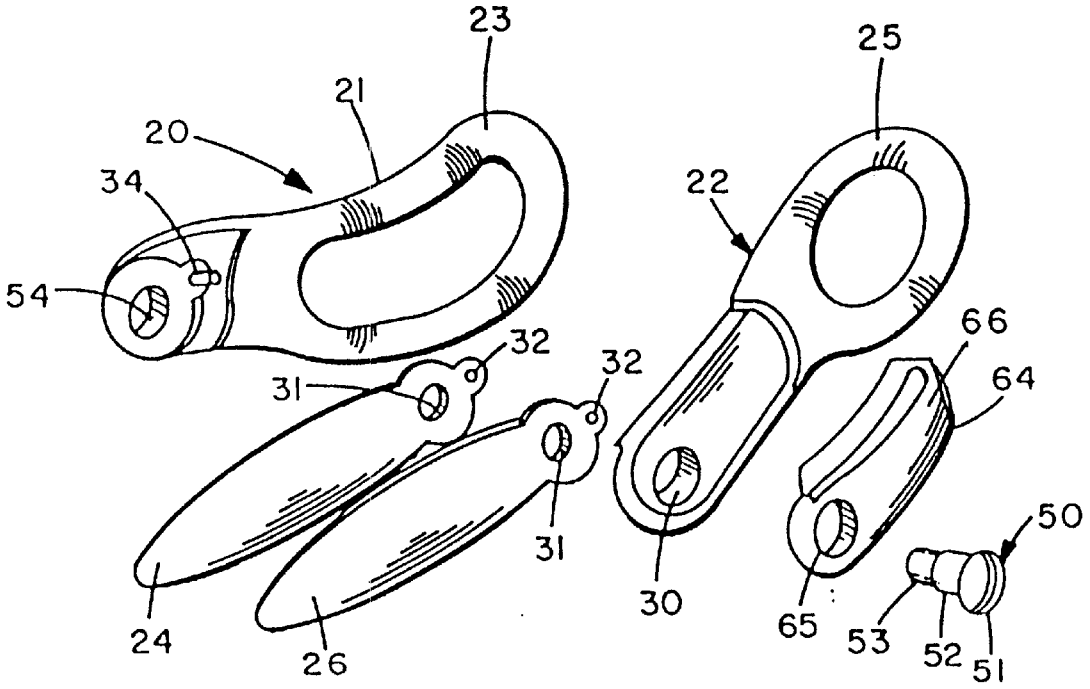
FIG. 14 is an exploded view of a still further alternate embodiment of the scissors construction of the present invention.
Figure 15:
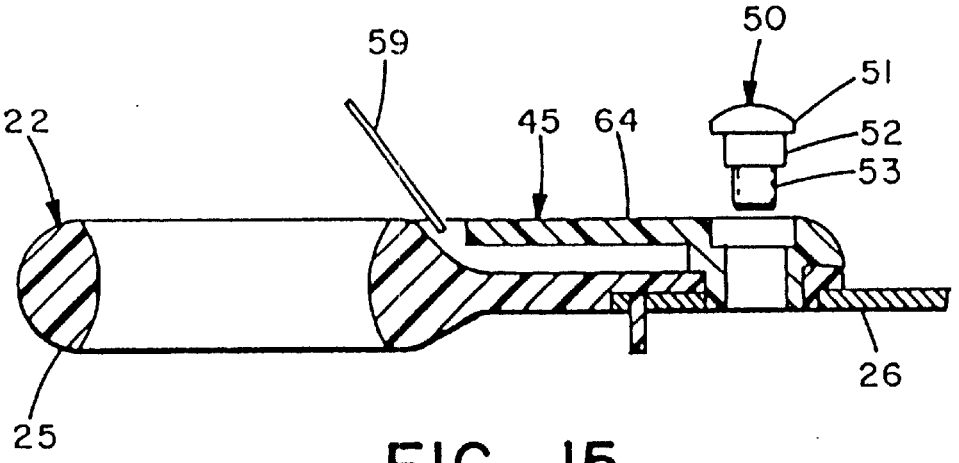
FIG. 15 is a cross-sectional side view of one arm member of the scissors construction embodiment depicted in FIG. 14.

In FIGS. 14 and 15, a further alternate embodiment is depicted for constructing scissors 20 of the present invention with identification label holding and displaying zone 45 associated therewith. In this embodiment, as with the embodiments detailed above in reference to FIGS. 10–13, scissors 20 is constructed with arm members 21 and 22 formed from handle portions 23 and 25 with blade portions 24 and 26 securely mounted to each other. In addition, locking/pivot screw 50 is employed for securely holding and maintaining arm members 21 and 22 in pivotable interengaged interconnection with each other, as well as providing the requisite pivot surface for handle portions 23 and 25 and blade portions 24 and 26.

In order to establish the desired identification label holding and displaying zone 45, this embodiment of scissors 20 incorporates cover member 64 which is fixedly mounted to handle portion 25 in secure engagement therewith. In the preferred embodiment, cover member 64 is formed from transparent material, and comprises a construction which enables cover member 64 to peripherally surround and securely engage a substantial portion of handle portion 25. In addition, in the preferred embodiment, cover member 64 incorporates a passageway 65 through which locking/pivot screw 50 passes for enabling cylindrical shaft portion 52 to pass therethrough and cooperate therewith enabling pivotal movement of cover members 64 along with handle portion 25.

In the preferred construction, terminating edge 66 of cover member 64 is constructed for being spaced away from the adjacent edge of handle portion 25. In this way, a slot is formed between cover members 64 and handle portion 25 enabling identification label or tag 59 to be inserted therebetween. In this way, once a label or tag 59 is inserted between cover member 64 and handle portion 25, the indicia printed thereon is readily visible through transparent cover member 64, providing the desired identification label holding and displaying zone 45 for this embodiment of the present invention.

In FIGS. 26–29, another preferred embodiment of a pivotable arm member construction of the present invention is shown, with the pivotable arm member comprising scissors 20. As with the previous embodiment, scissors 20 comprises a pair of pivotable arm members 21 and 22. Arm member 21 comprises a handle portion 23 and a blade portion 24, while arm member 22 comprises a handle portion 25 and a blade portion 26.

In addition, arm members 21 and 22 are mounted for arcuate pivoting movement relative to each other. In this embodiment, the pivoting interengagement of arm members 21 and 22 is achieved in a generally conventional manner by forming enlarged passageways 30 in handle portions 23 and 25, while also forming pivot receiving passageways 31 in blade members 24 and 26. In order to complete this construction, pivot pin/fastening means 99 is mounted in the aligned passageways 30 and 31 for securely maintaining arm members 21 and 22 interengaged with each other, while also providing independent arcuate pivoting motion of arm members 21 and 22 about the axis defined by fastening means 99.

In the preferred construction of this embodiment of the present invention, holding and displaying zone 45 is formed by providing an enlarged, oval-shaped cavity 100 which is formed in handle portion 23 of arm member 21. In addition, a removable panel or plate 101 is constructed with a size and shape which enables panel 101 to be inserted in and securely retained by oval cavity 100. As detailed herein, although an oval shape is preferred for cavity 100 and panel 101, any alternate shape can be employed with equal efficacy.

In the preferred construction, holding and displaying zone 45 is constructed for receiving, maintaining, and displaying any desired substantially flat member 102. In general, member 102 comprises one selected from the group consisting of indicia bearing members, photographs, pictures, and other similar items. Regardless of the member being retained, a secure holding and displaying zone 45 is provided for assuring ready visibility and protection of member 102 mounted in zone 45.

In order to enable member 102 to be inserted into cavity 100 and be readily visible through panel 101, panel 101 is preferably formed from transparent material and comprises an overall cross-sectional shape which enables panel 101 to function as a lens, effectively enlarging the visual appearance of the indicia bearing member, photo, picture, or other item retained in holding and displaying zone 45. In this way, the visibility and readability of member 102 is enhanced. Although the formation of panel 101 as a lens is preferred, this construction is not required and panel 101 may be formed from any clear, transparent or translucent material without departing from the scope of the present invention.

In its preferred construction, panel 101 is quickly and easily inserted into cavity 100 for secure retention, as well as being easily removable therefrom whenever desired. In order to assure ease of insertion and secure retention of panel 101 in cavity 100, cavity 100 and panel 101 comprise mating, arcuately curved side edges constructed for locking engagement and disengagement.

Figure 28:
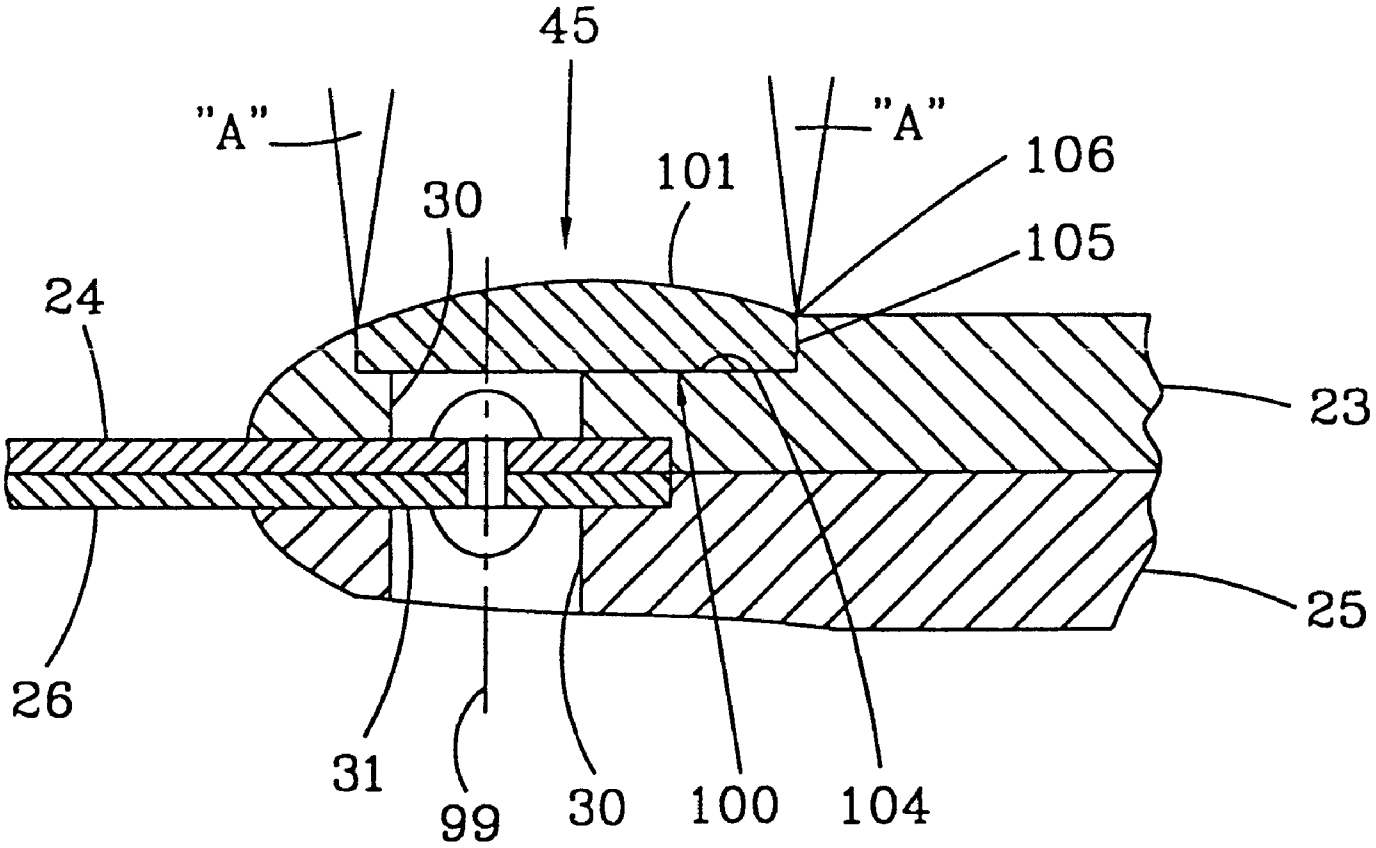
FIG. 28 is a cross-sectional side elevation view, partially broken away, taken along line 28—28 of FIG. 26.
Figure 29:
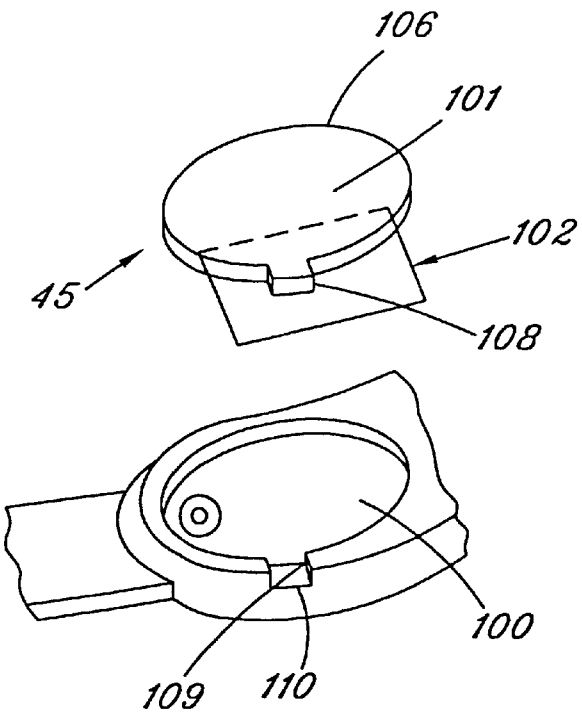
FIG. 29 is an exploded perspective view of one arm member of the scissors of FIG. 26 depicting the construction of this alternate embodiment.

As best seen in FIGS. 28 and 29, cavity 100 comprises a substantially flat base 104 and an upstanding wall 105 peripherally surrounding and substantially enveloping base 104. In its preferred construction wall 105 is constructed with an arcuately curved, cross-sectional shape, with the upper, terminating edge thereof extending inwardly.

If desired, wall 105 may comprise a substantially vertical portion directly adjacent base 104, with an inwardly extending terminating end portion. In this way, an alternate construction for holding panel 101 is provided.

In its preferred construction, panel 101 comprises an outer terminating edge 106 which comprises a smooth, rounded, arcuately curved, cross-sectional shape. In the preferred embodiment, wall 105 of cavity 100 and outer edge 106 of panel 101 are both formed with substantially identical radii of curvature "A". In this way, the desired secure, mating, locked engagement of panel 101 in cavity 100 is assured.

By employing this preferred construction, panel 101 is quickly and easily inserted into locking engagement with cavity 100. In order to attain the desired engagement, a portion of terminating edge 106 of panel 101 is brought into mating engagement with a portion of wall 105 of cavity 100 with these components being fully engaged with each other due to their complementary, curved construction.

The securement process is then completed by forcing the remainder of edge 106 into engagement with the remainder of wall 105 of cavity 100. Once fully engaged, curved outer edge 106 of panel 101 is mounted in secure, locked engagement with curved wall 105 of cavity 100.

By employing this construction, secure nested engagement of panel 101 with cavity 100 is achieved in a simple, easily attained one-step process. In addition, panel 101 is lockingly retained in cavity 100, in a manner which prevents unwanted dislodgement thereof.

Prior to placing panel 101 in secure locked engagement with cavity 100, the desired member 102 is placed on base 104 of cavity 100. Then, when panel 101 is positioned in overlying engagement with member 102 and securely mounted in place, the desired member 102 is retained in cavity 100 and fully visible through panel 101.

A further feature of this embodiment of the present invention is the achievement of a construction which enables panel 101 to be quickly and easily removed from cavity 100 whenever desired. In order to provide this capability, panel 101 incorporates a flange 108 which radially extends outwardly from edge 106. In addition, cavity 100 incorporates a portal or opening 109 formed in wall 105 which is constructed and positioned for receiving flange 108.

Figure 26:
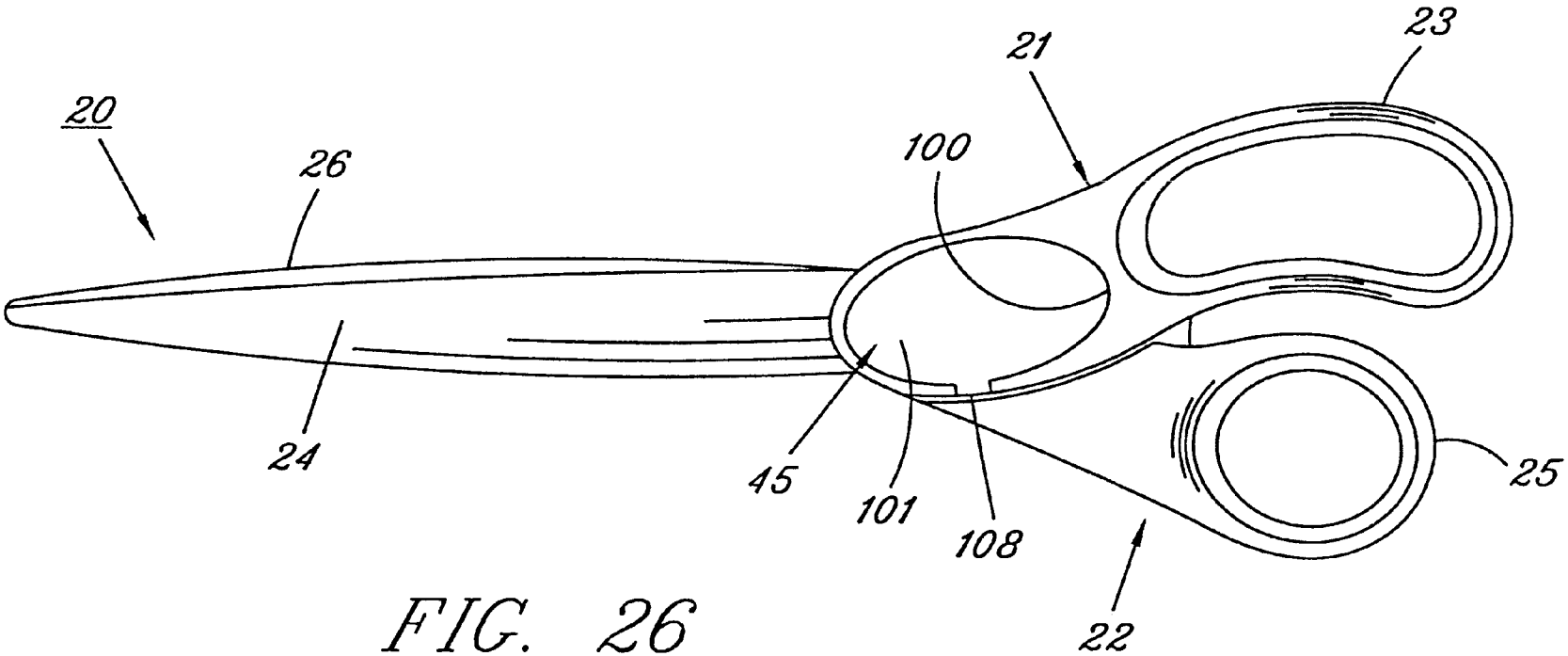
FIG. 26 is a top plan view of an additional further alternate embodiment of the scissors construction of the present invention.
Figure 27:
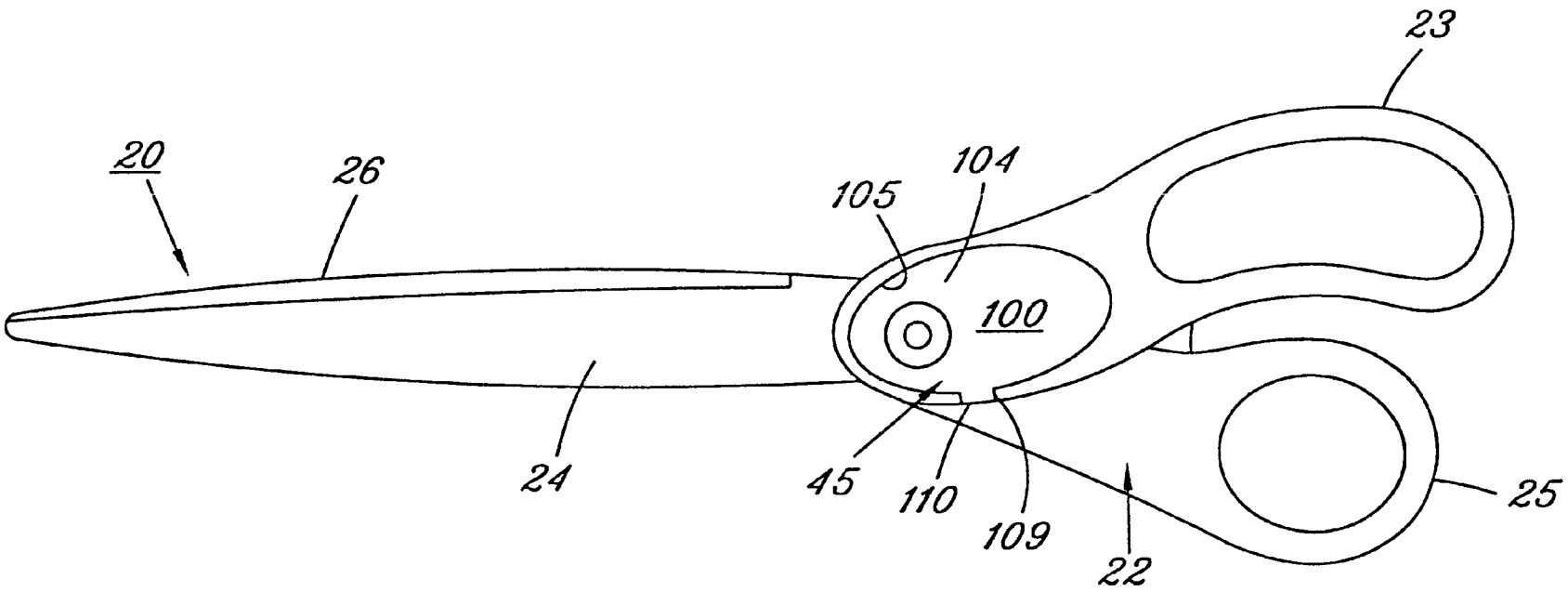
FIG. 27 is a top plan view of the embodiment of the scissors of FIG. 26 shown with the display panel thereof removed from the receiving cavity.

As best seen in FIGS. 26 and 27, portal 109 of cavity 100 is positioned along a side edge of handle 23 of arm member 21. In this way, flange 108 of panel 101 is located in an easily and readily accessible area, enabling the user to quickly reach and remove panel 101 from cavity 100 whenever desired.

Furthermore, as best seen in FIG. 29, handle 23 incorporates a recess area or zone 110 formed therein, directly below portal 109. By incorporating recess zone 110 below portal 109, any user is able to easily insert one's fingernail below flange 108 and, by exerting a lifting action, quickly remove panel 101 from cavity 100. In this way, panel 101 is easily removed from cavity 100 without requiring any special tools or special equipment.

As is apparent from the foregoing detailed discussion, numerous alternate embodiments may be employed for providing a stationery product 20 in the form of a pair of scissors, with each embodiment incorporating an easily employed, distinctive and unique identification label holding and displaying zone. Although several alternate embodiments have been fully detailed in the foregoing disclosure, further alternate constructions are capable of being employed without departing from the scope of the present invention. Consequently, the embodiments detailed above are provided as examples of alternate constructions and all additional alternate embodiments are intended to be within the scope of the present invention.

As discussed above, numerous different stationery products may be constructed incorporating an identification label holding and displaying zone in accordance with the present invention. As an example of one such other product, in addition to the scissors detailed above, FIGS. 16–23 and 31 detail stationery product 20 in the form of rulers incorporating identification label holding and displaying zones 45.

In each of these embodiments, ruler 20 comprises a substantially flat, elongated, rectangular shaped body member 70 on which any desired indicia may be printed, in the manner well known in the art. Typically, such indicia includes calibrated measuring units, such as inches, millimeters, etc. In this regard, any desired indicia may be printed on body member 70 without departing from the scope of this invention.

In the embodiment detailed in FIGS. 16–19, in order to provide the desired identification label holding and displaying zone 45 as an integral part of ruler 20, ruler 20 incorporates arm member 71. In its preferred construction, arm member 70 comprises a substantially rectangularly shaped section 72 which is integrally interconnected with a substantially circular shaped section 73. As will be evident from the following the detailed disclosure, sections 72 and 73 may comprise any desired shape. However, the shapes depicted in FIGS. 16–19 and discussed herein are preferred and, as a result, are detailed as the preferred examples for forming arm member 71.

In the preferred construction, rectangular section 72 of arm member 71 is formed from transparent material and incorporates an elongated display area or zone 75 of reduced thickness which establishes an area for enabling any desired label or tag to be easily positioned and securely retained. In this way, the desired identification label holding and displaying zone 45 is provided.

In this embodiment of the present invention, arm member 71 is constructed to be arcuately pivotable relative to body member 70 of ruler 20. As a result, in order to establish the desired arcuate pivotability in an easily constructed and readily assembled manner, circular shaped section 73 of arm member 71 incorporates a plurality of locking tabs or lugs 76 extending from the bottom surface thereof. Preferably, lugs 76 are formed on section 73 in a manner which establishes a generally circular shaped array, with each lug 76 being equally spaced away from a central axis point.

In addition, body member 70 of ruler 20 incorporates a plurality of notches 77 preferably formed adjacent one edge thereof and dimensioned for receiving and lockingly engaging tabs or lugs 76 of arm member 71. In addition, notches 77 also incorporate camming surfaces 78 cooperatively associated therewith for receiving and cammingly locking and securing tabs or lugs 76 to body member 70.

By employing this construction, arm member 71 is quickly and easily inserted into locked, pivotable interengagement with body member 70 of ruler 20. In order to fully assemble this embodiment of the present invention, locking tabs or lugs 76 are inserted through notches 77 of body member 70 and arm member 71 is pivoted about the axis defined by lugs 76. This movement causes locking tabs/lugs 76 to be cooperatively engaged and advanced over ramped camming surfaces 78 of body member 70.

In the preferred construction, lugs 76 slide along ramped, sloping, camming surfaces 78 until lugs 76 pass a raised portion or abutment wall thereof and become locked to body member 70. Once arm member 70 has moved from the assembly position to the locked position, locking tabs/lugs 76 are in locking engagement with camming surfaces 78, preventing the arcuate movement of arm member 71 beyond the abutment wall of cam surfaces 78.

Figure 16:
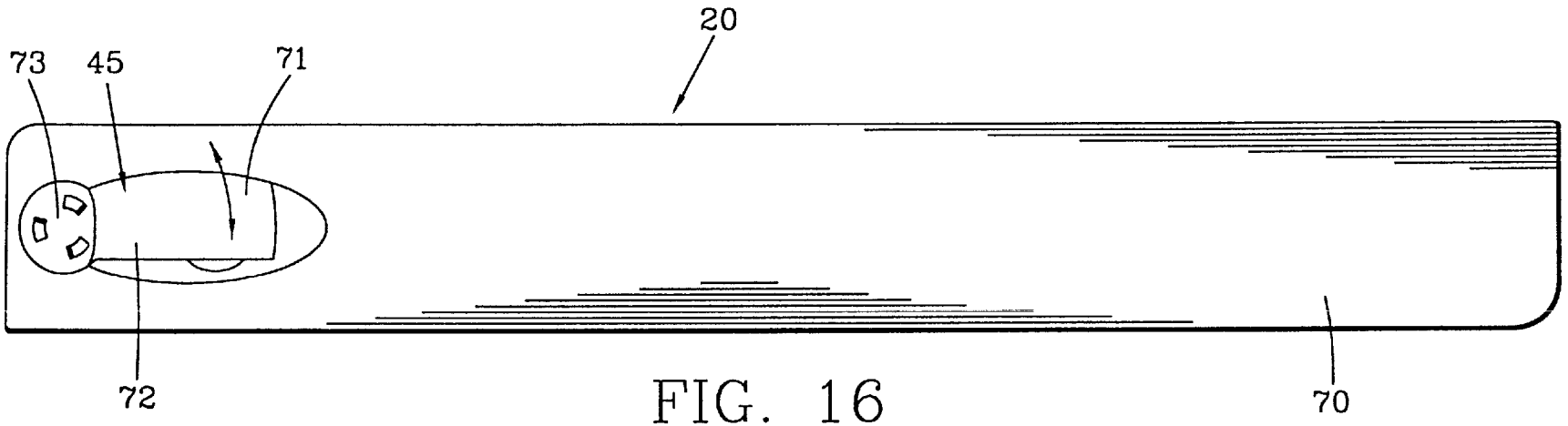
FIG. 16 is a top plan view of another embodiment of the stationery product of the present invention in the form of a ruler.
Figure 17:
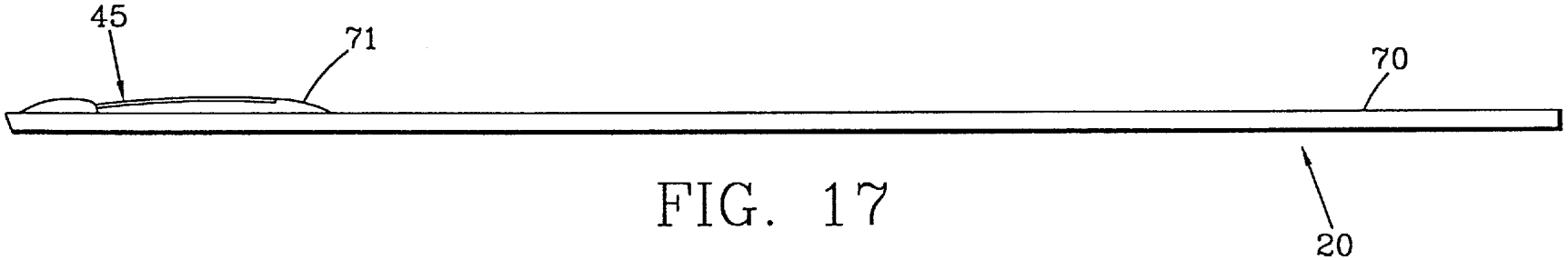
FIG. 17 is a side elevation view of the ruler of FIG. 16.
Figure 18:
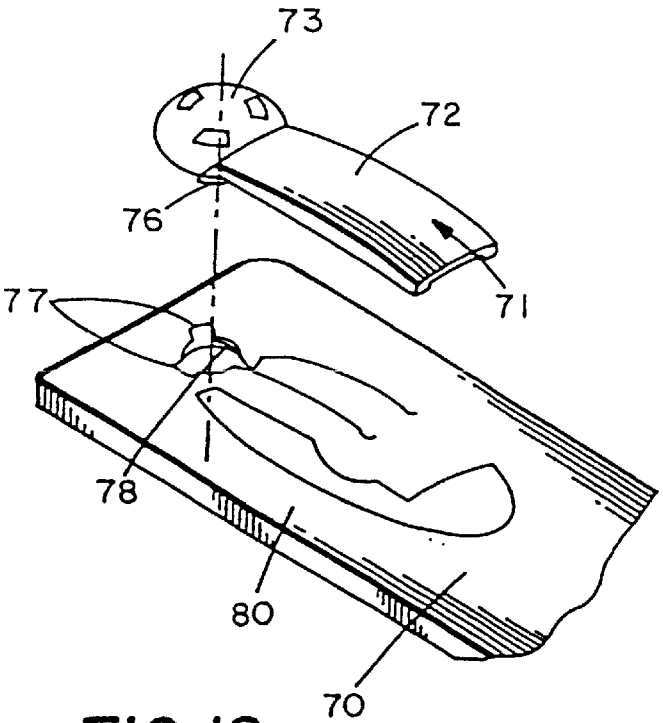
FIG. 18 is a top exploded perspective view, partially broken away, of the ruler of FIG. 16.
Figure 19:
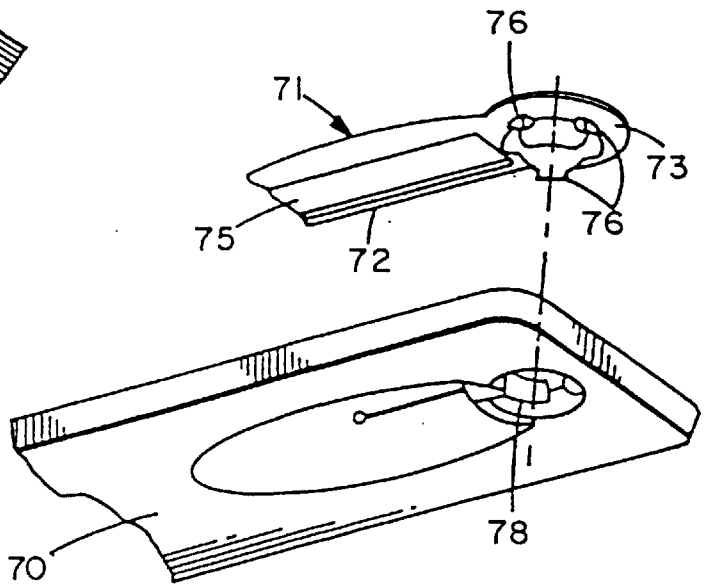
FIG. 19 is a bottom exploded perspective view, partially broken away, of the ruler of FIG. 16.

In this way, arm member 71 is pivotally movable relative to body member 70 as shown by arrow 79 of FIG. 1 6. This pivotal movement enables a tag or label to be inserted within elongated display zone 75 of arm member 71 and then moved back to the desired retained and identification label holding and displaying position, as shown in FIG. 16.

In order to prevent unwanted movement of arm member 71 as well as provide a positive stop for arm member 71 when pivoted into its normal identification label displaying position, body member 70 of ruler 20 incorporates raised surface 80 which is constructed for partially surrounding rectangular section 72 of arm member 71 and provide a positive stop therefor. In addition, snap lock means are incorporated therewith in order to provide secure, locked interengagement between arm member 71 and raised portion 80.

By employing this construction, ruler 20 is easily achieved with the desired identification label holding and displaying zone 45 integrally incorporated therewith. However, although the construction detailed above is preferred, for its ease of manufacture and its simplicity of assembly, alternate constructions can be employed for providing ruler 20 with an identification label displaying and retaining zone. By referring to FIGS. 20–23, along with the following disclosure, these alternate constructions can best be understood.

Figure 21:
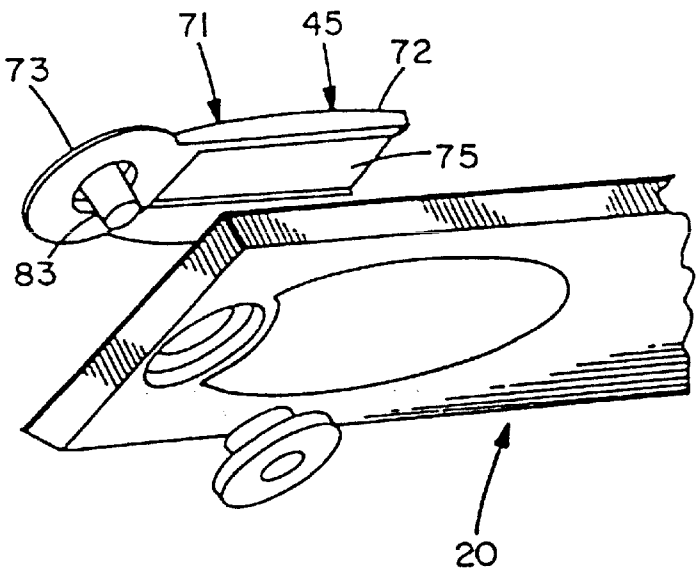
FIGS. 20 and 21 are both bottom perspective views of two further alternate embodiments of ruler constructions of the present invention.
Figure 20:
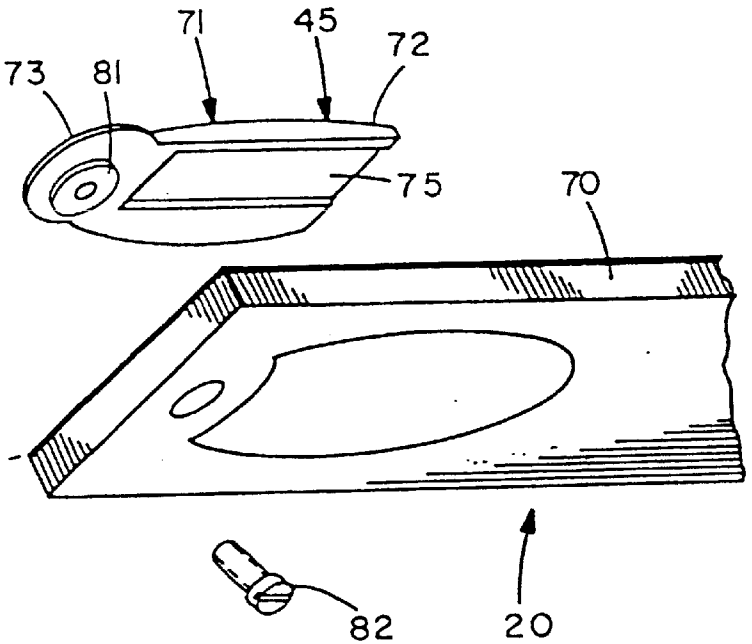
Figure 22:
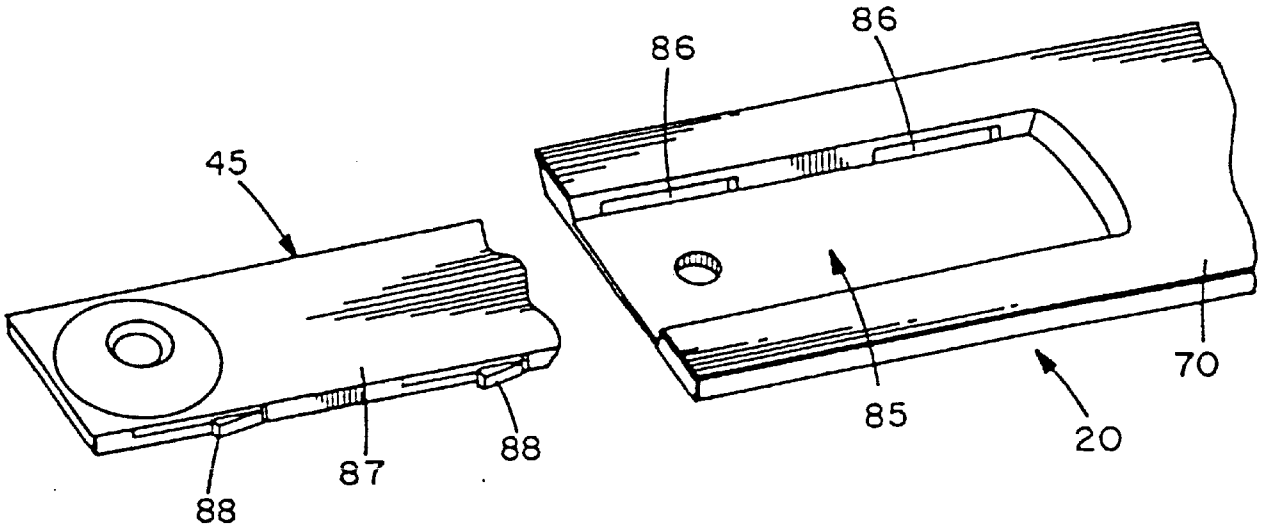
FIGS. 22 and 23 are both top perspective views of two still further alternate embodiments of ruler constructions of the present invention.

In FIGS. 20 and 21, two alternate embodiments for constructing ruler 20 with the desired identification label holding and displaying zone 45 are depicted. In each of these embodiments, arm member 71 is pivotally mounted to body member 70 for use and operation in the manner detailed above in reference to FIGS. 16–19. In addition, in each of these embodiments, arm member 71 is constructed in a manner substantially identical to the construction detailed above, with arm member 71 incorporating rectangular section 72, circular section 73, and elongated label or tag receiving zone 75. However, in each of these embodiments, arm member 71 is pivotally mounted to body member 70 using alternate constructions.

In the embodiment depicted in FIG. 20, arm member 71 incorporates a circular boss 81 extending from the bottom surface of circular section 73 which is cooperatively associated with an accommodating receiving cavity formed in the top surface of body portion 70. In this embodiment, in order to securely affix arm member 71 to body member 70 in a manner which provides arcuate pivoting movement of arm member 71 relative to body member 70, fastening means 82 is employed. Preferably, fastening means 82 comprises a threaded screw which is securely affixed to a receiving hole formed in circular boss 82. However, if desired, any alternate fastening member may be employed without departing from the scope of this invention.

In the embodiment depicted in FIG. 21, arm member 71 incorporates a cylindrically shaped pin 83 extending from the bottom surface of circular section 73. Pin 83 mates with a receiving hole formed in body portion 70 of ruler 20 and is securely retained in this desired position for pivotal movement relative to body member 70 by circular shaped fastening cap 84. In this way, the desired arcuate pivoting movement of arm member 71 relative to body member 70 is achieved in a quickly and easily assembled manner, providing ruler 28 with the desired identification label holding and displaying zone 45 integrally formed thereon.

Figure 23:
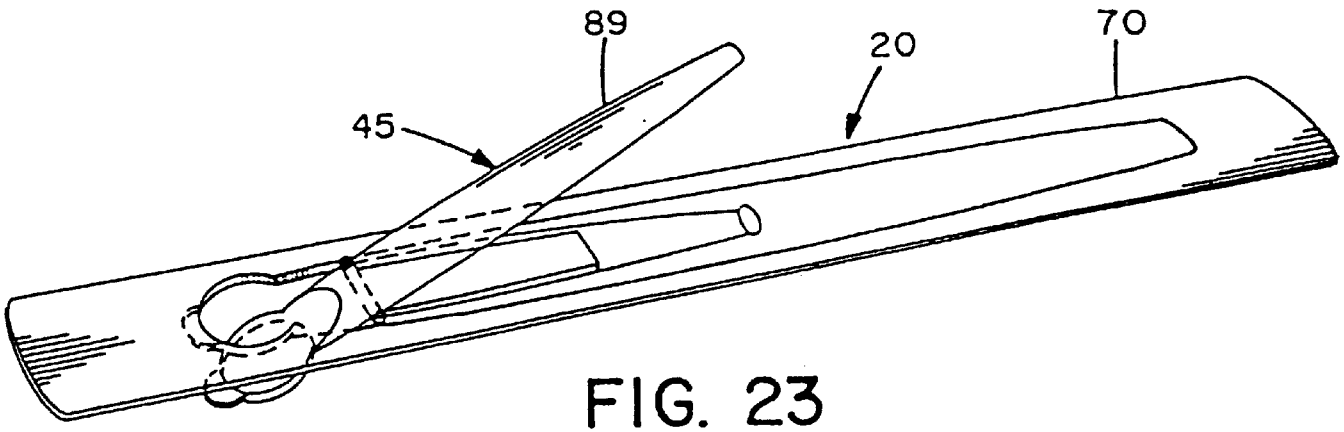

In FIG. 23, a further alternate embodiment is depicted for providing ruler 20 with the desired identification label holding and displaying zone 45. In this embodiment, ruler 20 incorporates body member 70 within which in an elongated cavity 85 is formed. Preferably, elongated cavity 85 extends from one side edge of body member 70 and comprises a substantially rectangular shape. In addition, slots 86 are formed in opposed side edges of elongated cavity 85.

In order to provide the desired identification label holding and displaying zone 45, this embodiment of the present invention incorporates a substantially rectangular shape plate member 87 which is dimensioned for sliding engagement and securement with elongated cavity 85. In order to assure secure locked interengagement of plate member 87 within recess cavity 85, plate member 87 incorporates a plurality of locking fingers 88 extending from the side edges thereof, positioned for a mating, locking interengagement with slots 86 of cavity 85. As a result, once plate member 87 is slidingly engaged within cavity 85, fingers 88 are moved into biased engagement with slots 86, assuring locked engagement of plate member 87 within cavity 85. Preferably, disengaging means are incorporated into plate member 87 to enable fingers 88 to be dislodged from slots 86, in order to allow plate member 87 to the removed from cavity 85 when desired.

By constructing plate member 87 from transparent material, and preferably incorporating a tag or label receiving zone on one surface thereof, plate member 87, when positioned in locked interengagement with cavity 85 of body member 70, provides the desired identification label holding and displaying zone 45 in an easily assembled, effective manner, in accordance with the teaching of the present invention.

FIG. 23 depicts a further alternate embodiment for providing ruler 20 with the desired identification label holding and displaying zone 45 of the present invention. In this embodiment, ruler 20 incorporates body member 70 on which elongated plate 89 is pivotally mounted. However, in this embodiment, plate 89 is pivotally mounted relative to the top surface of body member 70 about an axis which is parallel to the side edges of body member 70. This arcuate pivotal motion is distinctly different from the pivoting movement of arm member 71 detailed above, wherein the pivot axis is perpendicular to the top surface of body member 70.

In the preferred construction of this embodiment, body member 70 incorporates a recess or cavity zone formed in the top surface thereof which accommodates the dimensions of plate 89. As result, pushing one end of plate 89 in a generally downward direction causes the opposed end of plate 89 to move in the opposite direction, revealing a recess zone within which any desired tag or label can be placed. Then, by returning plate 89 to its original position, the tag or label inserted in the receiving zone is on display and the desired identification label holding and displaying zone 45 is realized.

Figure 31:
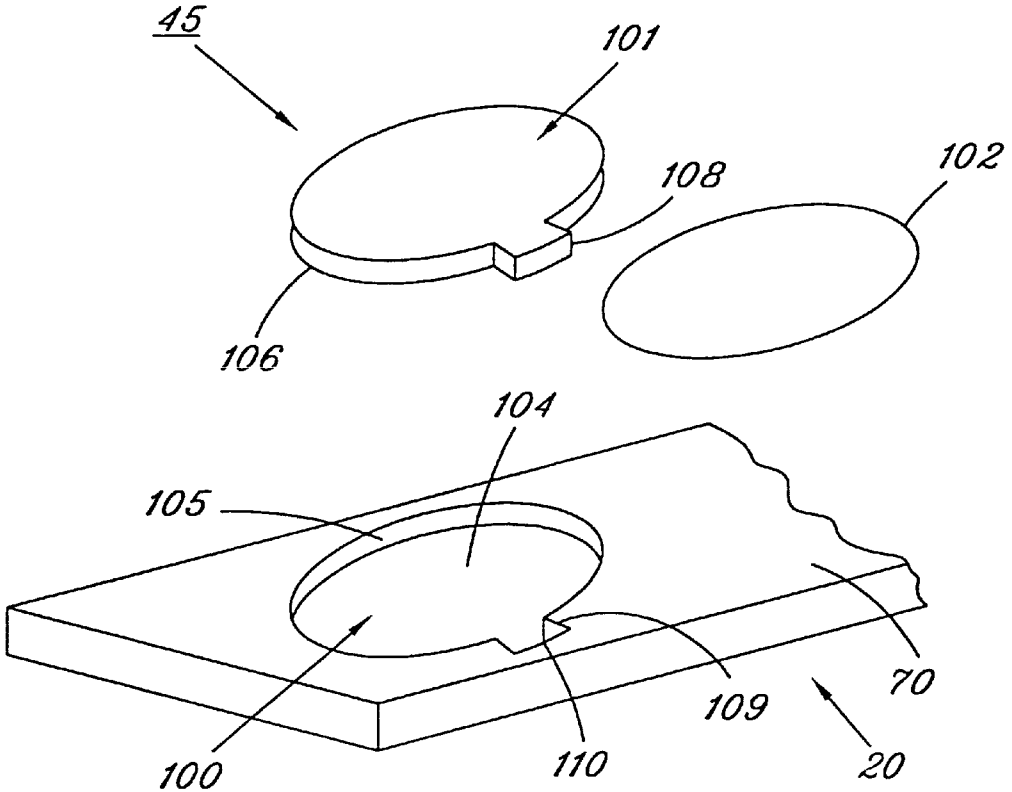
FIG. 31 is a partial exploded perspective view of a still further alternate embodiment of a stationery product of the present invention in the form of a ruler.

In FIG. 31, a final alternate embodiment is depicted for providing ruler 20 with the desired identification label holding and displaying zone 45 in accordance with the present invention. In this embodiment, ruler 20 incorporates a body member 70 in which cavity 100 is formed. In the preferred construction, cavity 100 comprises a generally oval shape and is constructed for cooperating, locked engagement with panel 101 which is to be inserted and securely retained by cavity 100. Although an oval shape is preferred for both cavity 100 and panel 101, any alternate shape can be employed with equal efficacy.

As with the embodiments detailed above, holding and displaying zone 45 is constructed for receiving, maintaining and displaying any desired substantially flat member 102. In general, member 102 comprises one selected from the group consisting of indicia bearing members, photographs, pictures, and the like. Regardless of the member being retained, holding and displaying zone 45 is provided for assuring ready visibility and protection of member 102 in zone 45.

In order to enable member 102 to be inserted into cavity 100 and be readily visible through panel 101, panel 101 is preferably formed from transparent material and comprises an overall cross-sectional shape which enables panel 101 to function as a lens, effectively enlarging the visual appearance of the indicia bearing member, photo, picture, or other item retained in holding and displaying zone 45. In this way, the visibility and readability of member 102 is enhanced. Although the formation of panel 101 as a lens is preferred, this construction is not required and panel 101 may be formed from any clear, transparent, or translucent material without departing from the scope of the present invention.

In its preferred construction, panel 101 is quickly and easily inserted into cavity 100 for secure retention, as well as being easily removable therefrom whenever desired. In order to assure ease of insertion and secure retention of panel 101 in cavity 100, cavity 100 and panel 101 comprises mating, arcuately curved side edges constructed for locking engagement and disengagement.

As shown in FIG. 31, cavity 100 comprises a substantially flat base 104 and an upstanding wall 105 peripherally surrounding and substantially enveloping base 104. In its preferred construction, wall 105 is constructed with an arcuately curved, cross-sectional shape, with the upper terminating edges thereof extending inwardly.

In its preferred construction, panel 101 comprises an outer terminating edge 106 which comprises a smooth, rounded, arcuately curved cross-sectional shape. In the preferred embodiment, wall 105 of cavity 100 and outer edge 106 of panel 101 are both formed with substantially identical radii of curvatures. In this way, the desired secure, mating, locking engagement of panel 101 in cavity 100 is assured.

As discussed above in reference to FIGS. 26–29, panel 101 is quickly and easily inserted into locked engagement with cavity 100, by placing a portion of terminating edge 106 of panel 101 into mating engagement with a portion of wall 105 of cavity 100 and forcing the remainder of edge 106 into engagement with the remainder of wall 105 of cavity 100. By employing this construction, secure nested engagement of panel 101 with cavity 100 is achieved in a simple, easily attained, one-step process. In addition, panel 101 is lockingly retained in cavity 100, in a manner which prevents unwanted dislodged thereof.

In addition, as also detailed above, a further feature of this embodiment of the present invention is the achievement of a construction which enables panel 101 to be quickly and easily removed from cavity 100 whenever desired. In order to provide this capability, panel 101 incorporates a flange 108 which radially extends outwardly from edge 106. In addition, cavity 100 incorporates a portal or opening 109 formed in wall 105 which is constructed and positioned for receiving flange 108.

As shown in FIG. 31, portal 109 of cavity 100 is positioned along a side edge of body member 70 of ruler 20. In this way, flange 108 of panel 101 is located in an easily and readily accessible area, enabling the user to quickly reach and remove panel 101 from cavity 100, whenever desired.

Furthermore, body member 70 of ruler 20 also incorporates a recessed area or zone 110 formed therein, directly below portal 109. By incorporating recessed zone 110 below portal 109, any user is able to easily insert one's fingernail below flange 108 and, by exerting a lifting action, quickly remove panel 101 from cavity 100. In this way, panel 101 is easily removed from cavity 100 without requiring any special tools or special equipment.

As a result, it is apparent from the foregoing detailed disclosure that numerous alternate embodiments can be employed for achieving an identification label holding and displaying zone in direct association with a ruler. Although numerous alternate embodiments have been disclosed and discussed above in reference to FIGS. 16–23 and 31, these alternate embodiments are intended as examples of the present invention and are not intended as limiting the present invention to the specific embodiments. Consequently, since further alternate constructions can be employed in achieving a label holding and displaying zone in association with ruler 20, it is intended that the foregoing embodiments, as well as all of the alternate embodiments which are capable of being employed, are encompassed within the scope of the present invention.

Figure 30:
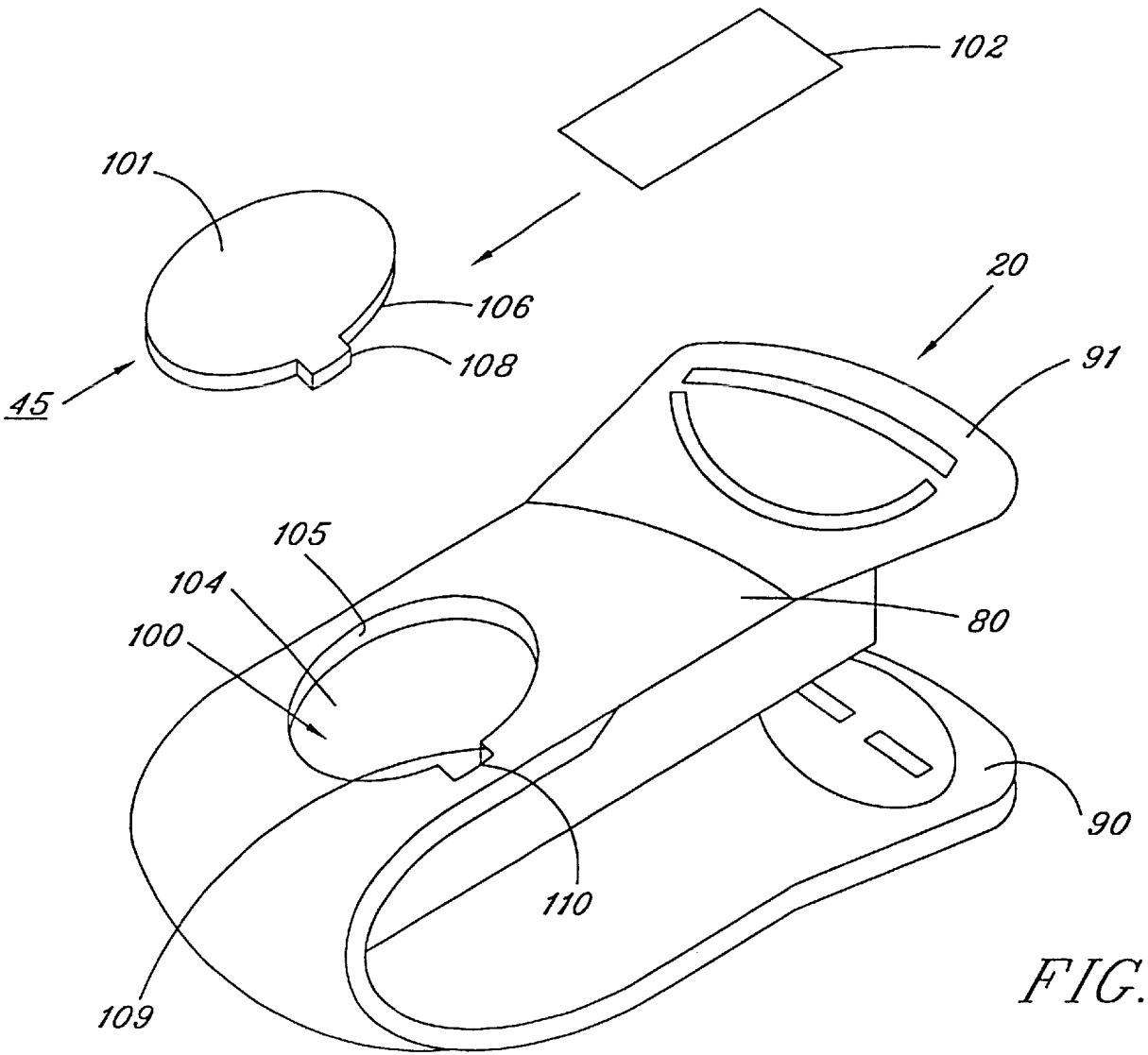
FIG. 30 is an exploded perspective view of a still further alternate embodiment of a stationery product of the present invention in the form of a stapler.

In FIGS. 24, 25 and 30, a further examples of another stationery product incorporating the present invention is depicted. In these embodiments, stationery product 20 comprises a stapler which incorporates an identification label holding and displaying zone 45 integrally formed therewith.

In these embodiments, stapler 20 comprises a generally conventional construction incorporating a base 90 and a staple holding and dispensing chamber 91 which is pivotally mounted to base 90. In order to incorporate identification label holding and displaying zone 45 as an integral part of stapler 20 in the embodiment of FIGS. 24 and 25, stapler 20 incorporates an arm member 71 pivotally mounted to staple holding and dispensing chamber 91.

In the preferred construction of this embodiment, arm member 71 is constructed in a manner substantially identical to the construction detailed above in FIGS. 16–19 with arm member 71 being mounted to staple holding and dispensing chamber 91 in a substantially identical manner as detailed above in these figures. As a result, arm member 71 preferably incorporates a rectangular section 72 integrally interconnected with circular section 73. In addition, circular section 73 incorporates locking tabs or lugs 76 mounted to the bottom surface thereof, with locking lugs being constructed in a substantially circular array, as detailed above.

Furthermore, rectangular section 72 incorporates an elongated display area or zone 75 having a reduced thickness, for establishing the area which enables any desired label 59 to be easily positioned and securely retained therein. In addition, as discussed above, rectangular section 72 is formed from transparent material, in order to enable the indicia placed on identification label or tag 59 to be easily viewed therethrough.

In order to enable arm member 71 to be securely affixed to staple holding and dispensing chamber 86, as well as pivotally mounted relative thereto, chamber 86 incorporates notches 77 and camming surfaces 78 formed therein for cooperative, locking interengagement with tabs/lugs 76 of arm member 71 in the manner detailed above. As result, once arm member 71 is positioned and placed in locked interengagement with chamber 86, arm member 71 is capable of arcuate pivoting movement relative to chamber 86 in a specific, controlled, arcuate distance.

As detailed above, the arcuate movement of arm member 71 is constructed to enables tag or label 59 to be inserted into display area 75, and then pivoted back to its original position for maintaining tag or label 59 in the precisely desired location for complete visibility through rectangular section 72. In this way, the desired identification label holding and displaying zone 45 is attained in a further stationery product, providing consumers with another product with the desired display system.

In FIG. 30, a final alternate embodiment is depicted for providing stapler 20 with the desired identification label holding and displaying zone 45 in accordance with the present invention. In this embodiment, stapler 20 incorporates a body member in which cavity 100 is formed. In the preferred construction, cavity 100 comprises a generally oval shape and is constructed for cooperating, locked engagement with panel 101 which is to be inserted and securely retained by cavity 100. Although an oval shape is preferred for both cavity 100 and panel 101, any alternate shape can be employed with equal efficacy.

As with the embodiments detailed above, holding and displaying zone 45 is constructed for receiving, maintaining and displaying any desired substantially flat member 102. In general, member 102 comprises one selected from the group consisting of indicia bearing members, photographs, pictures, and the like. Regardless of the member being retained, holding and displaying zone 45 is provided for assuring ready visibility and protection of member 102 in zone 45.

In order to enable member 102 to be inserted into cavity 100 and be readily visible through panel 101, panel 101 is preferably formed from transparent material and comprises an overall cross-sectional shape which enables panel 101 to function as a lens, effectively enlarging the visual appearance of the indicia bearing member, photo, picture, or other item retained in holding and displaying zone 45. In this way, the visibility and readability of member 102 is enhanced. Although the formation of panel 101 as a lens is preferred, this construction is not required and panel 101 may be formed from any clear, transparent, or translucent material without departing from the scope of the present invention.

In its preferred construction, panel 101 is quickly and easily inserted into cavity 100 for secure retention, as well as being easily removable therefrom whenever desired. In order to assure ease of insertion and secure retention of panel 101 in cavity 100, cavity 100 and panel 101 comprises mating, arcuately curved side edges constructed for locking engagement and disengagement.

As shown in FIG. 31, cavity 100 comprises a substantially flat base 104 and an upstanding wall 105 peripherally surrounding and substantially enveloping base 104. In its preferred construction, wall 105 is constructed with an arcuately curved, cross-sectional shape, with the upper terminating edges thereof extending inwardly.

In its preferred construction, panel 101 comprises an outer terminating edge 106 which comprises a smooth, rounded, arcuately curved cross-sectional shape. In the preferred embodiment, wall 105 of cavity 100 and outer edge 106 of panel 101 are both formed with substantially identical radii of curvatures. In this way, the desired secure, mating, locking engagement of panel 101 in cavity 100 is assured.

As discussed above in reference to FIGS. 26–29 and 31, panel 101 is quickly and easily inserted into locked engagement with cavity 100, by placing a portion of terminating edge 106 of panel 101 into mating engagement with a portion of wall 105 of cavity 100 and forcing the remainder of edge 106 into engagement with the remainder of wall 105 of cavity 100. By employing this construction, secure nested engagement of panel 101 with cavity 100 is achieved in a simple, easily attained, one-step process. In addition, panel 101 is lockingly retained in cavity 100, in a manner which prevents unwanted dislodged thereof.

In addition, as also detailed above, a further feature of this embodiment of the present invention is the achievement of a construction which enables panel 101 to be quickly and easily removed from cavity 100 whenever desired. In order to provide this capability, panel 101 incorporates a flange 108 which radially extends outwardly from edge 106. In addition, cavity 100 incorporates a portal or opening 109 formed in wall 105 which is constructed and positioned for receiving flange 108.

As shown in FIG. 31, portal 109 of cavity 100 is positioned along a side edge of body member 70 of ruler 20. In this way, flange 108 of panel 101 is located in an easily and readily accessible area, enabling the user to quickly reach and remove panel 101 from cavity 100, whenever desired.

Furthermore, the body member forming stapler 20 also incorporates a recessed area or zone 110 formed therein, directly below portal 109. By incorporating recessed zone 110 below portal 109, any user is able to easily insert one's fingernail below flange 108 and, by exerting a lifting action, quickly remove panel 101 from cavity 100. In this way, panel 101 is easily removed from cavity 100 without requiring any special tools or special equipment.

It will thus be seen that the objects set forth above, among those made apparent from the preceding description, are efficiently attained and, since changes may be made in constructing the articles detailed herein, without departing from the scope of the present invention, it is intended that all matter contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention what we claim as new and desire to secure by Letters Patent is:

1. An indicia displaying stationery product which enables users to place any desired indicia bearing member in a protective, readily viewable area, said product comprising:

A. a stationery product-forming body having a. a construction enabling said product-forming body to be easily carried to alternate positions for normal use, and b. an exposed, readily visible surface formed on said product-forming body, and B. a display assembly cooperatingly associated with the exposed surface of the stationery product forming body and comprising, a. an indicia bearing member receiving zone constructed for enabling any desired indicia bearing member to be mounted therein, and incorporating 1. a base forming portion, and
2. a wall member having a fixed height, extending upwardly from the base forming portion in peripheral surrounding relationship therewith, and comprising an open zone or portal formed therein, said open zone/portal extending through the entire height of the wall member, and b. a removable panel
1. formed at least partially from transparent material for enabling the indicia bearing member to be viewable there-through,
2. having an outer terminating edge dimensioned for cooperative engagement and retention with the wall member of the receiving zone,
3. constructed for being quickly and easily inserted into and removed from engagement with the wall member of the receiving zone; and
4. comprising a flange radially extending from the outer terminating edge thereof, with said flange being dimensioned for co-operatively engaging and extending through said open zone/portal of the wall member of the receiving zone for being readily accessible for enabling the panel to be easily removed from engagement in the receiving zone.

2. The stationery product defined in claim 1, wherein said indicia bearing member is further defined as comprising one selected from the group consisting of pictures, photographs, and indicia bearing sheets.

3. The stationery product defined in claim 1, wherein the wall member is further defined as comprising an arcuately curved, portion integrally formed therein.

4. The stationery product defined in claim 3, wherein said wall member is further defined as having a smooth, upwardly extending, arcuate radius of curvature formed on a substantial portion thereof.

5. The stationery product defined in claim 4, wherein the terminating edge incorporates a smooth, arcuate radius of curvature substantially equivalent to the radius of curvature of the wall member of the receiving zone.

6. The stationery product defined in claim 5, wherein the removable panel and the receiving zone both comprise substantially oval shapes.

7. The stationery product defined in claim 1, wherein said open zone/portal is further defined as comprising a recess zone cooperatively associated therewith for providing easy access to the flange of the removable panel whenever access thereto is required.

8. Indicia displaying scissors which enable users to place any desired indicia bearing member in a protected, readily viewable area, said scissors comprising:

A. a pair of arm members pivotally mounted together, with each arm member comprising a blade portion and a handle portion; and B. a display assembly formed in one handle portion of one arm member, and comprising a. an indicia bearing member receiving zone constructed for enabling any desired indicia bearing member to be mounted therein, and incorporating
1. a base forming portion, and
2. a wall member having a fixed height, extending upwardly from the base forming portion in peripheral surrounding relationship therewith, and comprising an open zone or portal formed therein, said open zone/portal extending through the entire height of the wall member, and b. a removable panel
1. formed at least partially from transparent material for enabling the indicia bearing member to be viewable therethrough,
2. having an outer terminating edge dimensioned for cooperative engagement and retention with the wall member of the receiving zone,
3. constructed for being quickly and easily inserted into and removed from engagement with the wall member of the receiving zone; and
4. comprising a flange radially extending from the outer terminating edge thereof, with said flange being dimensioned for co-operatively engaging and extending through said open zone/portal of the wall member of the receiving zone for being readily accessible for enabling the panel to be easily removed from engagement in the receiving zone.

9. The indicia displaying scissors defined in claim 8, wherein said indicia bearing member is further defined as comprising one selected from the group consisting of pictures, photographs, and indicia bearing sheets.

10. The indicia bearing scissors defined in claim 8, wherein the wall member of the receiving zone of the display assembly is further defined as comprising an arcuately curved, portion integrally formed therein.

11. The indicia bearing scissors defined in claim 10, wherein said wall member is further defined as having a smooth, upwardly extending, arcuate radius of curvature formed on a substantial portion thereof.

12. The indicia displaying scissors defined in claim 11, wherein the terminating edge incorporates a smooth, arcuate radius of curvature substantially equivalent to the radius of curvature of the wall member of the receiving zone.

13. The indicia displaying scissors defined in claim 12, wherein the removable panel and the receiving zone both comprise substantially oval shapes.

14. The indicia displaying scissors defined in claim 8, wherein said open zone or portal is further defined as comprising a recess zone cooperatively associated therewith for providing easy access to the flange of the removable panel whenever access thereto is required.

* * * * *